US008695529B2

(12) United States Patent
Fukui

(10) Patent No.: US 8,695,529 B2
(45) Date of Patent: Apr. 15, 2014

(54) APPLICATION APPARATUS AND IMAGE FORMING APPARATUS

(75) Inventor: Takashi Fukui, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 584 days.

(21) Appl. No.: 12/889,162

(22) Filed: Sep. 23, 2010

(65) Prior Publication Data

US 2011/0067627 A1 Mar. 24, 2011

(30) Foreign Application Priority Data

Sep. 24, 2009 (JP) ..... 2009-219378

(51) Int. Cl.
*B05C 1/00* (2006.01)
*B05D 5/00* (2006.01)
*B41F 7/02* (2006.01)

(52) U.S. Cl.
USPC ..... 118/244; 427/428.01; 101/218

(58) Field of Classification Search
None
See application file for complete search history.

(56) References Cited

U.S. PATENT DOCUMENTS

| | | | | | |
|---|---|---|---|---|---|
| 3,506,467 | A | * | 4/1970 | Ulrich | 428/205 |
| 4,414,896 | A | * | 11/1983 | Fischer | 101/211 |
| 4,569,306 | A | * | 2/1986 | Ito et al. | 118/249 |
| 5,142,979 | A | * | 9/1992 | Funada et al. | 101/183 |
| 5,272,975 | A | * | 12/1993 | Dettinger et al. | 101/218 |
| 6,000,336 | A | | 12/1999 | Leib | |

FOREIGN PATENT DOCUMENTS

| | | | |
|---|---|---|---|
| JP | 58-183260 | A | 10/1983 |
| JP | 11-268444 | A | 10/1999 |
| JP | 2001-293853 | A | 10/2001 |
| JP | 2002-361939 | A | 12/2002 |
| JP | 2008-200972 | A | 9/2008 |
| JP | 2009-119636 | A | 6/2009 |

* cited by examiner

*Primary Examiner* — Dah-Wei Yuan
*Assistant Examiner* — Charles Capozzi
(74) *Attorney, Agent, or Firm* — Birch, Stewart, Kolasch & Birch, LLP

(57) ABSTRACT

An application apparatus includes: a medium conveying device which holds and conveys a medium in a predetermined conveyance direction; an application roller which applies a liquid to the medium held by the medium conveying device; an application roller rotating device which rotates the application roller at a predetermined rotational speed; a measuring roller which feeds a predetermined measured amount of the liquid to the application roller; a measuring roller rotating device which rotates the measuring roller at a predetermined rotational speed; a first moving device which causes relative movement between the application roller and the medium conveying device to change a distance between the application roller and the medium conveying device; a second moving device which causes relative movement between the application roller and the measuring roller to change a distance between the application roller and the measuring roller; and a movement controlling device which controls the second moving device in such a manner that, when the application roller and the medium are brought into abutment with each other from a state in which the application roller and the medium are separated from each other, a front end part of the medium in terms of the conveyance direction abuts with an abutment position on a circumferential surface of the application roller when the application roller and the measuring roller are brought into abutment with each other from a state in which the application roller and the measuring roller are separated from each other.

7 Claims, 16 Drawing Sheets

APPLICATION APPARATUS AND IMAGE FORMING APPARATUS

BACKGROUND OF THE INVENTION

1. Field of the Invention

The present invention relates to an application apparatus and an image forming apparatus, and particularly relates to an application technology for applying liquid to a sheet-like medium such as a cut sheet.

2. Description of the Related Art

As a general image forming apparatus, there is an inkjet recording apparatus, which forms a desired image on a recording medium by ejecting and depositing a plurality of colors of inks onto the recording medium from a plurality of nozzles provided in an inkjet head. The recording media used in the inkjet recording apparatus are not just paper media, but also include media of a plurality of types, such as resin sheet, metal sheet, and the like, and furthermore media of various sizes and thicknesses are used.

There are some inkjet recording apparatuses that employ a method in which, in order to accomplish highly precise image formation, a recording medium before an image is rendered is supplied with aggregating treatment liquid for aggregating or insolubilizing ink and then the ink is deposited onto the recording medium. Application of this two-liquid aggregation method can realize preferred image formation without causing ink bleed or color displacement even when not only a paper medium but also a resin sheet, a metallic sheet, or any other non-(hardly-)permeable medium is used.

A roller application method with an application roller is used as a method of evenly applying the aggregating treatment liquid to the entire surface of a recording medium (a relatively wide area of the recording medium). The roller application method is capable of applying a large amount of application liquid (the aggregating treatment liquid) to the recording medium irrespectively of the properties of the application liquid, and of forming an application liquid layer with even thickness onto the recording medium.

Japanese Patent Application Publication No. 11-268444 discloses a varnishing apparatus that feeds an application cylinder with varnish, the amount of which is measured by a transfer roll, and brings the application cylinder into contact with a printing sheet held on an impression cylinder, to apply the varnish to the printing sheet.

However, when a plurality of sheets (recording media) are applied with the liquid by means of the roller application method, the application quantity on a single recording medium changes due to the return liquid that is not applied onto the recording medium from the liquid fed to the application roller.

Problems caused by the related art are described with reference to FIGS. 14A to 14D and FIG. 15. FIGS. 14A to 14D are schematic diagrams explaining a roller application method that uses an application roller 300 to apply an application liquid to a plurality of sheets (recording media) 304 held on the circumferential surface 302A of an impression cylinder 302. FIG. 15 is a diagram showing an application state in which the sheets 304 are applied with the application liquid by the roller application method.

FIG. 14A shows a state in which a first recording medium 304-1 is applied with a liquid. A certain amount of the liquid that is accumulated on an application tray 306 is measured by a measuring roller (anilox roller) 308 and fed continuously to an application roller 300. The liquid held on the surface of the application roller 300 is applied on a recording medium 304 that is moved as the cylinder 302 rotates.

Because the feeding of the liquid from the measuring roller 308 to the application roller 300 continues even at the time of non-application when the recording medium 304 is not applied with the liquid, the liquid in an amount corresponding to a plurality of times of measurement performed the measuring roller 308 is fed to the application roller 300 at the time of non-application. As shown in FIG. 14A, when applying the liquid to the first recording medium 304-1, the liquid 310A in an amount corresponding to the plurality of times of measurement is applied upon the first rotation of the application roller 300.

On the other hand, when the first recording medium 304-1 is applied with the liquid in the second and subsequent rotations of the application roller 300, the recording medium is applied with the liquid 310B in an amount corresponding to a single measurement performed by the measuring roller 308. On the first recording medium 304-1 which has been applied with the liquid as shown in FIG. 14B, an area corresponding to the first rotation of the application roller 300 from a front end part 14A has been applied with a relatively thick liquid layer, and an area corresponding to the second rotation of the application roller 300 has been applied with a relatively thin liquid layer.

FIG. 14B shows a state in which a second recording medium (indicated by a reference numeral 304-2 in FIG. 14C) reaches a processing area of the application roller 300 after the application of the liquid onto the first recording medium 304-1 (a state at the time of non-application). As shown in FIG. 14B, the application roller 300 is separated from the impression cylinder circumferential surface 302A during the non-application. On the other hand, at the time of non-application as well, the application roller 300 continues to rotate and the feeding of the liquid to the application roller 300 by the measuring roller 308 is continued.

FIGS. 14C and 14D show states in which the second recording medium 304-2 is applied with the liquid. As shown in FIG. 14C, when the second recording medium 304-2 is applied with the liquid, first, the application roller 300 that is separated from the impression cylinder circumferential surface 302A is moved to come into contact with the recording medium 304-2 as soon as the second recording medium 304-2 reaches the processing area of the application roller 300, and then an application process is started.

During the period between when the application roller 300 is separated from the impression cylinder circumferential surface 302A and when the application roller 300 rotates completely (one rotation of the application roller 300 is completed), the liquid 310B in an amount corresponding to a single measurement performed by the measuring roller 308 is applied. In other words, the first area of the second recording medium 304-2 is applied with a relatively thin liquid layer.

Once the application roller 300 rotates completely after the application roller 300 is separated from the impression cylinder circumferential surface 302A, a relatively thick liquid layer is formed by adding the liquid in an amount corresponding to a single measurement performed by the measuring roller 308, to the liquid that is fed to the application roller 300 while the application roller 300 separates from the impression cylinder circumferential surface 302A. Specifically, as shown in FIG. 14D, when applying the liquid to the second recording medium 304-2, the area corresponding to the first rotation of the application roller 300 from the front end part 14A is applied with the liquid 310B in an amount corresponding to a single measurement performed by the measuring roller 308, and, out of the areas following this area, an area corresponding to the rotation of the separated application roller 300 is applied with liquid 310C which is obtained by adding the liquid in an amount corresponding to a single measurement performed by the measuring roller 308, to the liquid (the return liquid) fed to the application roller 300 during the separation.

FIG. 15 schematically shows a state in which the first recording medium 304-1 and the second recording medium 304-2 are applied with the application liquid by means of the roller application method shown in FIGS. 14A to 14D.

As shown in FIG. 15, on the first recording medium 304-1, a relatively thick liquid layer is applied onto an area 322, the length of which from the front end 320 is same as circumferential length L of the application roller (indicated by a reference numeral 300 in FIGS. 14A to 14D) in a conveyance direction, and a relatively thin liquid layer is applied onto an area 324 positioned on the rear end side of the area 322 in medium conveyance direction.

Furthermore, on the second recording medium 304-2, a relatively thin liquid layer is applied onto an area 330, the length of which from the front end 328 is $L_2(=L-L_1)$ in the conveyance direction, and an area 332 subsequent to the area 330 is applied with a relatively thick liquid layer. In addition, an area 334 subsequent to the area 332 is applied with a relatively thin liquid layer. Note that $L_1$ is a moving distance in a direction along the circumferential surface of the application roller 300 while the application roller 300 is being separated from the impression cylinder circumferential surface 302A.

In other words, in the roller application method shown in FIGS. 14A to 14D, when the plurality of recording media 304 are applied with the liquid, the application of the liquid onto a single recording medium is uneven between the area with relatively thick liquid and the area with relatively thin liquid, due to the fact that the length of each recording medium 304 in the conveyance direction does not match the circumferential length of the application roller 300.

In order to solve such a problem using the varnishing apparatus described in Japanese Patent Application Publication No. 11-268444, the blanket corresponding to the size of a sheet to be used needs to be replaced when changing the size of the recording medium. According to this method, the time consumed in the tool replacement increases, and a plurality of application rollers need to be prepared depending on the sizes of the recording media to be used.

SUMMARY OF THE INVENTION

The present invention has been contrived in view of such circumstances, and an object thereof is to provide an application apparatus and an image forming apparatus with which, when the size of a recording medium does not match the circumferential length of an application roller used in a roller application method, uneven application of liquid onto a single recording medium is prevented in such a manner that preferred liquid application can be realized when a plurality of recording media are applied with the liquid.

In order to attain an object described above, one aspect of the present invention is directed to an application apparatus comprising: a medium conveying device which holds and conveys a medium in a predetermined conveyance direction; an application roller which applies a liquid to the medium held by the medium conveying device; an application roller rotating device which rotates the application roller at a predetermined rotational speed; a measuring roller which feeds a predetermined measured amount of the liquid to the application roller; a measuring roller rotating device which rotates the measuring roller at a predetermined rotational speed; a first moving device which causes relative movement between the application roller and the medium conveying device to change a distance between the application roller and the medium conveying device; a second moving device which causes relative movement between the application roller and the measuring roller to change a distance between the application roller and the measuring roller; and a movement controlling device which controls the second moving device in such a manner that, when the application roller and the medium are brought into abutment with each other from a state in which the application roller and the medium are separated from each other, a front end part of the medium in terms of the conveyance direction abuts with an abutment position on a circumferential surface of the application roller when the application roller and the measuring roller are brought into abutment with each other from a state in which the application roller and the measuring roller are separated from each other.

In order to attain an object described above, another aspect of the present invention is directed to an application apparatus comprising: a medium conveying device which holds and conveys a medium in a predetermined conveyance direction; an application roller which applies a liquid to the medium held by the medium conveying device; an application roller rotating device which rotates the application roller at a predetermined rotational speed; a measuring roller which feeds a predetermined measured amount of the liquid to the application roller; a measuring roller rotating device which rotates the measuring roller at a predetermined rotational speed; a first moving device which causes relative movement between the application roller and the medium conveying device to change a distance between the application roller and the medium conveying device; a second moving device which causes relative movement between the application roller and the measuring roller to change a distance between the application roller and the measuring roller; and a movement controlling device which controls the second moving device so as to separate the application roller and the measuring roller from each other when an abutment position on a circumferential surface of the application roller which is brought into abutment with a rear end part of the medium in the conveyance direction reaches an abutment position in which the application roller and the measuring roller are brought into abutment with each other.

In order to attain an object described above, one aspect of the present invention is directed to an image forming apparatus comprising: a medium conveying device which holds and conveys a medium in a predetermined conveyance direction; an application roller which applies, to the medium held by the medium conveying device, a treatment liquid functioning to aggregate or insolubilize an ink; an application roller rotating device which rotates the application roller at a predetermined rotational speed; a measuring roller which feeds a uniform amount of the treatment liquid to the application roller; a measuring roller rotating device which rotates the measuring roller at a predetermined rotational speed; a first moving device which causes relative movement between the application roller and the medium conveying device to change a distance between the application roller and the medium conveying device; a second moving device which causes relative movement between the application roller and the measuring roller to change a distance between the application roller and the measuring roller; a movement controlling device which controls the second moving device in such a manner that, when the application roller and the medium are brought into abutment with each other from a state in which the application roller and the medium are separated from each other, a front end part of the medium in the conveyance direction abuts with an abutment position on a circumferential surface of the application roller in which the application roller and the measuring roller are brought into abutment with each other from a state in which the application roller and the measuring roller are separated from each other; and an image forming device which forms an image on the medium to which the treatment liquid has been applied.

According to the present invention, when the application roller and the measuring roller are brought into contact with each other from a state in which the application roller and the measuring roller are separated from each other, the measuring roller is brought into abutment with a position of the application roller in which the application roller abuts with the front end part of the medium in the conveyance direction. Thus, at the time of non-application, the liquid is not fed to the application roller, and return liquid that is not fed to the medium is prevented from occurring, whereby the uneven application caused by the return liquid is prevented.

DETAILED DESCRIPTION OF THE PREFERRED EMBODIMENTS

General Composition of Inkjet Recording Apparatus

Figure 1:
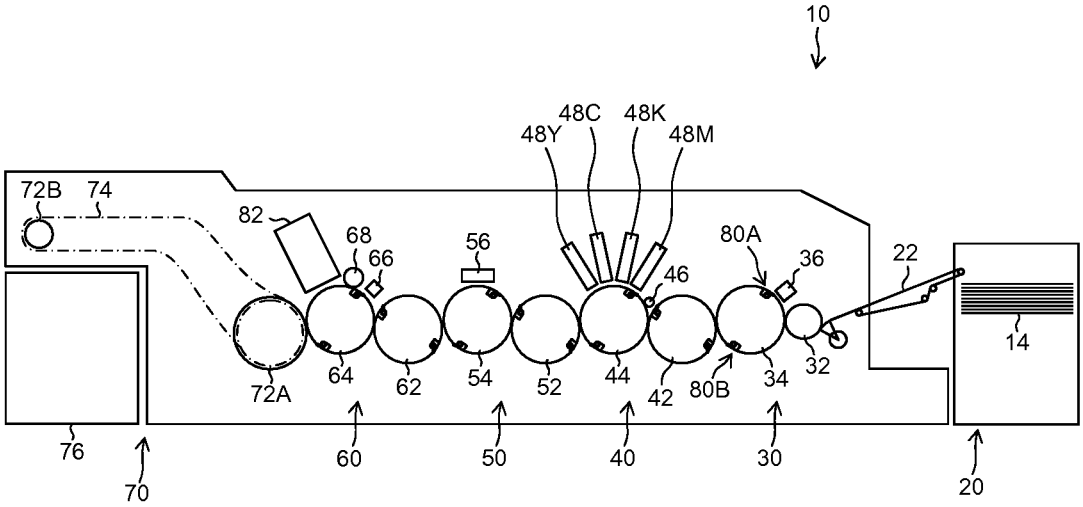
FIG. 1 is a general schematic drawing of an inkjet recording apparatus relating to an embodiment of the present invention.

FIG. 1 is a schematic drawing showing the general composition of an inkjet recording apparatus relating to the present embodiment. The inkjet recording apparatus 10 shown in FIG. 1 is a recording apparatus based on a two-liquid aggregation system which forms an image on a recording surface of a recording medium 14 on the basis of prescribed image data, by using ink containing coloring material and an aggregating treatment liquid having a function of aggregating the ink.

The inkjet recording apparatus 10 principally comprises a paper feed unit 20, a treatment liquid application unit 30, an image formation unit 40, a drying process device 56, a fixing process unit 60 and an output unit 70. Transfer drums 32, 42, 52, 62 are provided as devices which receive and transfer a recording medium 14 conveyed respectively from stages prior to the treatment liquid application unit 30, the image formation unit 40, the drying process device 56, and the fixing process unit 60, and furthermore, pressure drums 34, 44, 54, 64 having a drum shape are provided as devices for holding and conveying the recording medium 14 respectively in the treatment liquid application unit 30, the image formation unit 40, the drying process device 56 and the fixing process unit 60.

Grippers 80A and 80B which grip and hold the leading end portion of the recording medium 14 are provided on the transfer drums 32, 42, 52, 62 and the pressure drums 34, 44, 54, 64. The gripper 80A and the gripper 80B adopt a common structure for gripping and holding the leading end portion of the recording medium 14 and for transferring the recording medium 14 with respect to a gripper provided in another pressure drum or transfer drum; furthermore, the gripper 80A and the gripper 80B are disposed in symmetrical positions separated by 180° in the direction of rotation of the pressure drum 34 on the outer circumferential surface of the pressure drum 34.

When the transfer drums 32, 42, 52, 62 and the pressure drums 34, 44, 54, 64 which have gripped the leading end portion of a recording medium 14 by means of the grippers 80A and 80B rotate in a prescribed rotation, the recording medium 14 is rotated and conveyed following the outer circumferential surface of the transfer drums 32, 42, 52, 62 and the pressure drums 34, 44, 54, 64.

In FIG. 1, only the reference numerals of the grippers 80A and 80B provided on the pressure drum 34 are indicated, and the reference numerals of the grippers on the other pressure drums and transfer drums are not shown.

When a recording medium (cut sheet paper) 14 accommodated in the paper feed unit 20 is supplied to the treatment liquid application unit 30, an aggregating treatment liquid (hereinafter, simply referred to as "treatment liquid") is applied to the recording surface of the recording medium 14 held on the outer circumferential surface of the pressure drum 34. The "recording surface of the recording medium 14" is the outer surface when the medium is held by the pressure drums 34, 44, 54, 64, this being the surface opposite to the surface held on the pressure drums 34, 44, 54, 64.

Thereupon, the recording medium 14 on which aggregating treatment liquid has been deposited is output to the image formation unit 40 and colored ink is deposited by the image formation unit 40 onto the area of the recording surface where the aggregating treatment liquid has been deposited, thereby forming a desired image.

Moreover, a recording medium 14 on which an image has been formed by the colored inks is sent to the drying process device 56, and a drying process is carried out by the drying process device 56, in addition to which the medium is conveyed to the fixing process unit 60 after the drying process and a fixing process is carried out. By carrying out a drying process and a fixing process, the image formed on the recording medium 14 is made durable. In this way, a desired image is formed on the recording surface of the recording medium 14 and after fixing the image on the recording surface of the recording medium 14, the medium is conveyed to the exterior of the apparatus from the output unit 70.

The respective units of the inkjet recording apparatus 10 (paper feed unit 20, treatment liquid application unit 30, image formation unit 40, drying process device 56, fixing process unit 60 and output unit 70) are described in detail below.

Paper Feed Unit

The paper feed unit 20 comprises a paper feed tray 22 and a paying out mechanism (not illustrated) and is composed so as to pay out the recording medium 14 one sheet at a time from the paper feed tray 22. The recording medium 14 paid out from the paper feed tray 22 is registered in position by a guide member (not illustrated) and halted temporarily in such a manner that the leading end portion is disposed at the position of the gripper (not illustrated) on the transfer drum (paper feed drum) 32.

Treatment Liquid Application Unit

The treatment liquid application unit 30 comprises a pressure drum (treatment liquid drum) 34 which holds, on the outer circumferential surface thereof, a recording medium 14 transferred from the paper feed drum 32 and conveys the recording medium 14 in the prescribed conveyance direction, and a treatment liquid application apparatus 36 which applies treatment liquid to the recording surface of a recording medium 14 held on the outer circumferential surface of the treatment liquid drum 34. When the treatment liquid drum 34 is rotated in the counter-clockwise direction in FIG. 1, the recording medium 14 is conveyed so as to rotate in the counter-clockwise direction following the outer circumferential surface of the treatment liquid drum 34.

The treatment liquid application apparatus 36 shown in FIG. 1 is provided at a position facing the outer circumferential surface (recording medium holding surface) of the treatment liquid drum 34. One example of the composition of the treatment liquid application apparatus 36 is a mode which comprises a treatment liquid vessel (a liquid receiving dish 214 illustrated in FIG. 8) which stores treatment liquid, an uptake roller (an anilox roller 216 illustrated in FIG. 8) which is partially immersed in the treatment liquid in the treatment liquid vessel and which takes up the treatment liquid in the treatment liquid vessel, and an application roller (illustrated in FIG. 8 with reference numeral 210) which moves the treatment liquid taken up by the uptake roller, onto the recording medium 14.

A desirable mode is one which comprises an application roller movement mechanism which moves the application roller in the upward and downward direction (the normal direction with respect to the outer circumferential surface of the treatment liquid drum 34), so as to be able to avoid collisions between the application roller and the grippers 80A and 80B.

The treatment liquid deposited on the recording medium 14 by the treatment liquid application apparatus 36 contains a coloring material aggregating agent which aggregates the coloring material (pigment) in the ink deposited by the image formation unit 40, and when the treatment liquid and the ink come into contact with each other on the recording medium 14, the separation of the coloring material and the solvent in the ink is promoted.

Desirably, the treatment liquid application unit 30 doses the amount of treatment liquid applied to the recording medium 14 while applying the treatment liquid, and desirably, the thickness of the film of treatment liquid on the recording medium 14 is sufficiently smaller than the diameter of the ink droplets which are ejected from the image formation unit 40.

Image Formation Unit

The image formation unit 40 comprises a pressure drum (image formation drum) 44 which holds and conveys a recording medium 14, a paper pressing roller 46 for causing the recording medium 14 to adhere tightly to the image formation drum 44, and inkjet heads 48M, 48K, 48C and 48Y which deposit ink onto the recording medium 14. The basic structure of the image formation drum 44 is common to that of the treatment liquid drum 34 which is described previously, and therefore the description of it is omitted here.

The paper pressing roller 46 is a guide member for causing the recording medium 14 to make tight contact with the outer circumferential surface of the image formation drum 44, and is disposed facing the outer circumferential surface of the image formation drum 44, to the downstream side, in terms of the conveyance direction of the recording medium 14, of the transfer position of the recording medium 14 between the transfer drum 42 and the image formation drum 44 and to the upstream side, in terms of the conveyance direction of the recording medium 14, of the inkjet heads 48M, 48K, 48C and 48Y.

When the recording medium 14 which has been transferred from the transfer drum 42 to the image formation drum 44 is conveyed to rotate in a state where the leading end is held by a gripper (reference numeral not indicated), the recording medium 14 is pressed by the paper pressing roller 46 and is caused to make tight contact with the outer circumferential surface of the image formation drum 44. After the recording medium 14 has been caused to make tight contact with the outer circumferential surface of the image formation drum 44 in this way, the recording medium 14 is passed to a printing region directly below the inkjet heads 48M, 48K, 48C and 48Y, without any floating up of the medium from the outer circumferential surface of the image formation drum 44.

The inkjet heads 48M, 48K, 48C and 48Y respectively correspond to inks of the four colors of magenta (M), black (K), cyan (C) and yellow (Y), and are disposed in this order from the upstream side in terms of the direction of rotation of the image formation drum 44 (the counter-clockwise direction in FIG. 1), in addition to which the ink ejection surfaces of the inkjet heads 48M, 48K, 48C and 48Y (the nozzle surfaces, indicated by reference numeral 100A in FIG. 2) are disposed so as to face the recording surface of the recording medium 14 which is held on the image formation drum 44. Here, the "ink ejection surfaces (nozzle surfaces)" are surfaces of the inkjet heads 48M, 48K, 48C and 48Y which face the recording surface of the recording medium 14, and are the surfaces where the nozzles which eject ink as described below are formed (these nozzles are not shown in FIG. 1 and are indicated by reference numeral 102 in FIG. 2).

Furthermore, the inkjet heads 48M, 48K, 48C and 48Y shown in FIG. 1 are disposed at an inclination with respect to the horizontal plane in such a manner that the recording surface of the recording medium 14 which is held on the outer circumferential surface of the image formation drum 44 and the nozzle surfaces of the inkjet heads 48M, 48K, 48C and 48M are substantially parallel.

The inkjet heads 48M, 48K, 48C and 48Y are full line heads having a length corresponding to the maximum width of the image forming region on the recording medium 14 (the length of the recording medium 14 in the direction perpendicular to the conveyance direction), and are fixed so as to extend in a direction perpendicular to the conveyance direction of the recording medium 14.

Nozzles for ejecting ink are formed in a matrix configuration throughout the whole width of the image forming region of the recording medium 14 on the nozzle surfaces (liquid ejection surfaces) of the inkjet heads 48M, 48K, 48C and 48Y.

When the recording medium 14 is conveyed to a printing region directly below the inkjet heads 48M, 48K, 48C and 48Y, inks of respective colors are ejected (as droplets) on the basis of image data, from the inkjet heads 48M, 48K, 48C and 48Y onto the region of the recording medium 14 where an aggregating treatment liquid has been deposited.

When the droplets of the colored inks are ejected from the corresponding inkjet heads 48M, 48K, 48C and 48Y toward the recording surface of the recording medium 14 held on the outer circumferential surface of the image formation drum 44, the ink makes contact with the treatment liquid on the recording medium 14, and an aggregating reaction occurs with a coloring material (pigment-based coloring material) which is dispersed in the ink or a coloring material (dye-based coloring material) which can be insolubilized, thereby forming an aggregate of the coloring material. By this means, movement of the coloring material in the image formed on the recording medium 14 (namely, positional displacement of the dots, color non-uniformities of the dots) is prevented.

Furthermore, the image formation drum 44 of the image formation unit 40 is structurally separate from the treatment liquid drum 34 of the treatment liquid application unit 30, and therefore treatment liquid is never applied to the inkjet heads 48M, 48K, 48C and 48Y, and it is possible to reduce the causes of ink ejection abnormalities.

Although a configuration with the four standard colors of C, M, Y and K is described in the present embodiment, the combinations of the ink colors and the number of colors are not limited to these. Light and/or dark inks, and special color inks can be added as required. For example, a configuration is possible in which inkjet heads for ejecting light-colored inks, such as light cyan and light magenta, are added, and there is no particular restriction on the arrangement sequence of the heads of the respective colors.

Drying Process Unit

A drying process unit 50 comprises a pressure drum (drying drum) 54 which holds and conveys a recording medium 14 after image formation, and a drying process apparatus 56 which carries out a drying process for evaporating off the water content (liquid component) on the recording medium 14. The basic structure of the drying drum 54 is common with those of the treatment liquid drum 34 and the image formation drum 44 described previously, and therefore further description thereof is omitted here.

The drying process apparatus 56 is a processing unit which is disposed in a position facing the outer circumferential surface of the drying drum 54 and evaporates off the water content present on the recording medium 14. When ink is deposited on the recording medium 14 by the image formation unit 40, the liquid component (solvent component) of the ink and the liquid component (solvent component) of the treatment liquid which have been separated by the aggregating reaction between the treatment liquid and the ink remain on the recording medium 14, and therefore it is necessary to remove this liquid component.

The drying process apparatus 56 is a processing unit which carries out a drying process by evaporating off the liquid component present on the recording medium 14, through heating by a heater, or air blowing by a fan, or a combination of these, in order to remove the liquid component on the recording medium 14. The amount of heating and the air flow volume applied to the recording medium 14 are set appropriately in accordance with parameters, such as the amount of water remaining on the recording medium 14, the type of recording medium 14, the conveyance speed of the recording medium 14 (interference processing time), and the like.

When a drying process is carried out by the drying process device 56, since the drying drum 54 of the drying process device 56 is structurally separate from the image formation drum 44 of the image formation unit 40, then it is possible to reduce the causes of ink ejection abnormalities due to drying of the head meniscus portions in the inkjet heads 48M, 48K, 48C and 48Y as a result of the applied heat or air flow.

In order to display an effect in correcting cockling of the recording medium 14, the curvature of the drying drum 54 is desirably 0.002 (1/mm) or greater. Furthermore, in order to prevent curving (curling) of the recording medium after the drying process, the curvature of the drying drum 54 is desirably 0.0033 (1/mm) or less.

Moreover, desirably, a device for adjusting the surface temperature of the drying drum 54 (for example, an internal heater) may be provided to adjust the surface temperature to 50° C. or above. Drying is promoted by carrying out a heating process from the rear surface of the recording medium 14, thereby preventing destruction of the image in the subsequent fixing process. According to this mode, more beneficial effects are obtained if a device for causing the recording medium 14 to adhere tightly to the outer circumferential surface of the drying drum 54 is provided. Examples of a device for causing tight adherence of the recording medium 14 include a vacuum suctioning device, electrostatic attraction device or the like.

There are no particular restrictions on the upper limit of the surface temperature of the drying drum 54, but from the viewpoint of the safety of maintenance operations such as cleaning the ink adhering to the surface of the drying drum 54 (e.g. preventing burns due to high temperature), desirably, the surface temperature of the drying drum 76 is equal to or lower than 75° C. (and more desirably, equal to or lower than 60° C.).

By holding the recording medium 14 in such a manner that the recording surface thereof is facing outwards on the outer circumferential surface of the drying drum 54 having this composition (in other words, in a state where the recording surface of the recording medium 14 is curved in a projection shape), and carrying out a drying process while conveying the recording medium in rotation, it is possible reliably to prevent drying non-uniformities caused by wrinkling or floating up of the recording medium 14.

Fixing Process Unit

The fixing process unit 60 comprises a pressure drum (fixing drum) 64 which holds and conveys a recording medium 14, a heater 66 which carries out a heating process on the recording medium 14 which an image has been formed on and liquid has been removed from, and a fixing roller 68 which pressurizes the recording medium 14 from the recording surface side. The basic structure of the fixing drum 64 is common to that of the treatment liquid drum 34, the image formation drum 44 and the drying drum 54, and description thereof is omitted here. The heater 66 and the fixing roller 68 are disposed in positions facing the outer circumferential surface of the fixing drum 64, and are situated in this order from the upstream side in terms of the direction of rotation of the fixing drum 64 (the counter-clockwise direction in FIG. 1).

In the fixing process unit 60, a preliminary heating process by means of a heater 66 is carried out on the recording surface of the recording medium 14, and a fixing process by means of a fixing roller 68 is also carried out. The heating temperature of the heater 66 is set appropriately in accordance with the type of the recording medium, the type of ink (the type of polymer micro-particles contained in the ink), and the like. For example, a possible mode is one where the heating temperature is set to the glass transition temperature or the minimum film forming temperature of the polymer micro-particles contained in the ink.

The fixing roller 68 is a roller member for melting self-dispersing polymer micro-particles contained in the ink and thereby causing a state where the ink is covered by a film (a film is formed), by applying heat and pressure to the dried ink, and is composed so as to heat and pressurize the recording medium 14. More specifically, the fixing roller 68 is disposed so as to contact and press against the fixing drum 64, in such a manner that the fixing roller 68 serves as a nip roller with respect to the fixing drum 64. By this means, the recording medium 14 is sandwiched between the fixing roller 68 and the fixing drum 64 and is nipped with a prescribed nip pressure, whereby a fixing process is carried out.

An example of the composition of the fixing roller 68 is a mode where the roller is constituted by a heating roller which incorporates a halogen lamp inside a metal pipe made of aluminum, or the like, having good heat conductivity. If heat energy at or above the glass transition temperature of the polymer micro-particles contained in the ink is applied by heating the recording medium 14 by means of this heating roller, then the polymer micro-particles melt and a transparent film is formed on the surface of the image.

By applying pressure to the recording surface of the recording medium 14 in this state, the polymer micro-particles which have melted are pressed and fixed into the undulations in the recording medium 14, and the undulations in the image surface are thereby leveled out, thus making it possible to obtain a desirable luster. A desirable composition is one where fixing rollers 68 are provided in a plurality of stages, in accordance with the thickness of the image layer and the glass transition temperature characteristics of the polymer micro-particles.

Furthermore, desirably, the surface hardness of the fixing roller 68 is equal to or lower than 71°. By further softening the surface of the fixing roller 68, it is possible to expect effects in following the undulations of the recording medium 14 which are produced by cockling, and fixing non-uniformities caused by the undulations of the recording medium 14 are prevented more effectively.

The inkjet recording apparatus 10 shown in FIG. 1 comprises an in-line sensor 82 which is provided at a later stage of the processing region of the fixing process unit 60 (on the downstream side in terms of the direction of conveyance of the recording medium). The in-line sensor 82 is a sensor for reading the image formed on the recording medium 14 (or a test pattern (check pattern) formed in the margin area of the recording medium 14), and desirably employs a CCD line sensor.

In the inkjet recording apparatus 10 shown in the present embodiment, the presence and absence of ejection abnormalities in the inkjet heads 48M, 48K, 48C and 48Y are judged on the basis of the reading results of the in-line sensor 82. Furthermore, the in-line sensor 82 may include measurement devices for measuring the water content, surface temperature, luster (gloss level), and the like. According to this mode, parameters, such as the processing temperature of the drying process device 56 and the heating temperature and applied pressure of the fixing process unit 60, are adjusted appropriately on the basis of the water content, surface temperature and the read result for the luster, and thereby the above control parameters are properly controlled in accordance with the temperature alteration inside the apparatus and the temperature alteration of the respective parts.

Output Unit

As shown in FIG. 1, an output unit 70 is provided subsequently to the fixing process unit 60. The output unit 70 comprises an endless conveyance belt 74 wrapped about tensioning rollers 72A and 72B, and an output tray 76 in which a recording medium 14 after image formation is accommodated.

The recording medium 14 which has undergone the fixing process and which is output from the fixing process unit 60 is conveyed by the conveyance belt 74 and output to the output tray 76.

Structure of Inkjet Head

Next, the structure of the inkjet heads 48M, 48K, 48C and 48Y provided in the image formation unit 40 will be described. The inkjet heads 48M, 48K, 48C and 48Y corresponding to the respective colors have a common structure, and therefore these inkjet heads are represented by an inkjet head (hereinafter, simply called "head") indicated by the reference numeral 100 below.

Figure 2:
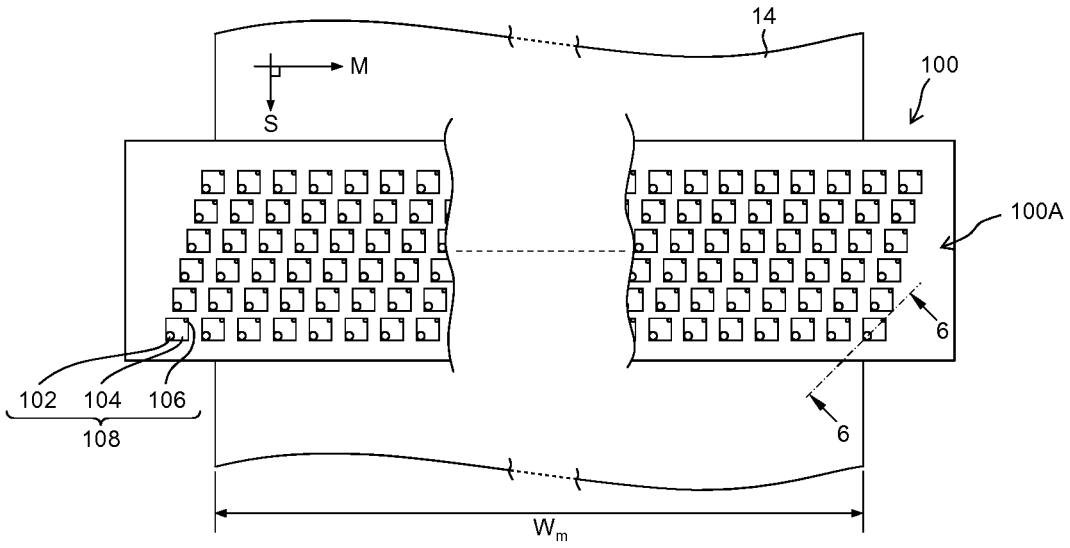
FIG. 2 is a plan view perspective diagram showing an example of the composition of an inkjet head.

FIG. 2 is a plan view perspective diagram showing an example of the structure of the head 100. In the present specification, parts which are the same as or similar to diagrams described previously are labelled with the same reference numerals and further explanation thereof is omitted here.

As shown in FIG. 2, the head is a full line type of head having a structure in which a plurality of nozzles 102 are arranged through a length corresponding to the full width $W_m$ of the recording medium 14, on the nozzle surface 100A of the head 100. The conveyance direction S of the recording medium 14 may be called the sub-scanning direction, and the direction M which is perpendicular to the conveyance direction S of the recording medium 14 may be called the main scanning direction.

In order to achieve a high density of the dot pitch formed onto the surface of the recording medium 14, it is necessary to achieve a high density of the nozzle pitch in the head 100. As shown in FIG. 2, the head 100 according to the present embodiment has a structure in which a plurality of ink chamber units (liquid droplet ejection elements forming recording element units) 108 are arranged in a matrix configuration, each ink chamber unit comprising a nozzle 102 which is an ink ejection port, a pressure chamber 104 connected to the nozzle 102 and a supply port 106 which connects the pressure chamber 104 to a common flow channel (not illustrated), whereby a high density of the nozzles is achieved by the effective nozzle interval that is obtained by projecting the nozzles in the main scanning direction, which is the lengthwise direction of the head 100 (the projected nozzle pitch indicated by the reference numeral $P_n$ in FIG. 3).

Each pressure chamber 104 connected to each nozzle 102 has an approximately square planar shape, the nozzle 102 being provided in one of two corners on the diagonal line and the supply port 106 being provided in the other corner. The shape of the pressure chamber 104 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

Figure 3:
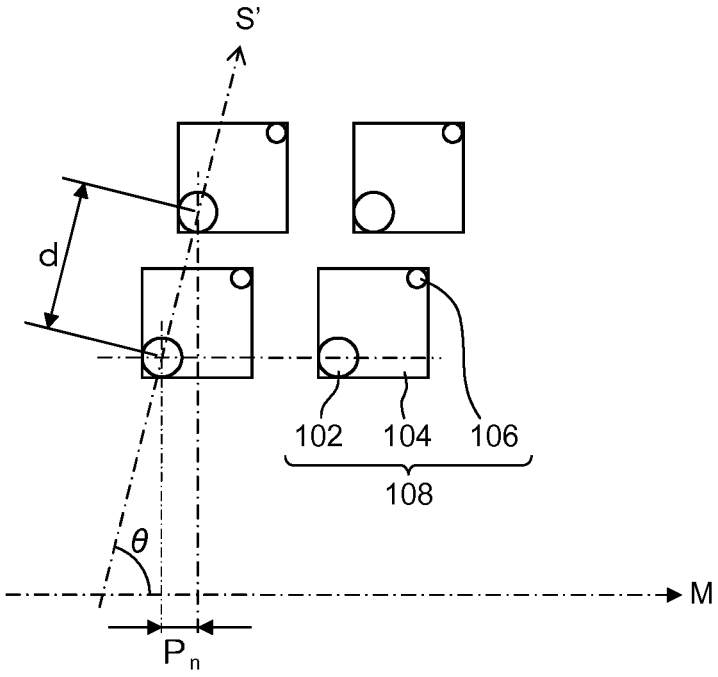
FIG. 3 is a partial enlarged diagram of the inkjet head shown in FIG. 2.

FIG. 3 is an enlarged diagram showing an enlarged view of a portion of the head 100 shown in FIG. 2. As shown in FIG. 3, the high-density nozzle head of the present embodiment is achieved by arranging ink chamber units 108 comprising a nozzle 102, pressure chamber 104, and the like, in a matrix configuration according to a prescribed arrangement pattern following a row direction aligned in the main scanning direction (indicated by reference numeral M) and an oblique column direction (indicated by reference numeral S') having a prescribed angle θ(0°<θ<90°) which is not perpendicular to the main scanning direction.

More specifically, by adopting a structure in which a plurality of ink chamber units 108 are arranged at a uniform pitch d in line with a direction forming an angle of θ with respect to the main scanning direction, the projected nozzle pitch $P_n$ of the nozzles projected to an alignment in the main scanning direction is d×cos θ, and hence it is possible to treat the nozzles 102 as if they are arranged linearly at a uniform pitch of $P_n$. By means of this composition, it is possible to achieve a high-density arrangement, in which the nozzle columns projected to an alignment in the main scanning direction reach a total of 2400 per inch (2400 nozzles per inch).

Figure 4:
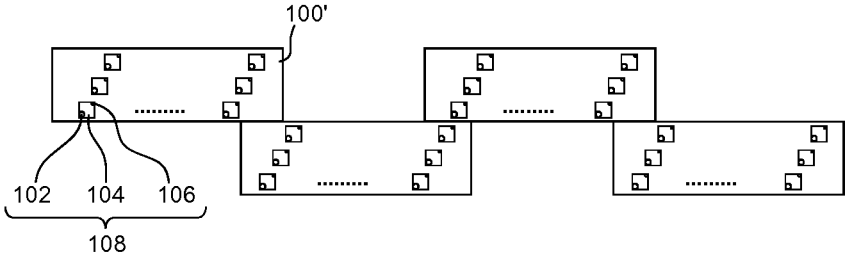
FIG. 4 is a plan view perspective diagram showing a further example of the composition of the inkjet head shown in FIG. 2.

An embodiment constituting one or more nozzle rows covering a length corresponding to the full width $W_m$ of the recording medium 14 is not limited to the present example. For example, instead of the composition in FIG. 2, as shown in FIG. 4, a line head having nozzle rows of a length corresponding to the entire width of the recording medium 14 can be formed by arranging and combining, in a staggered matrix, short head modules 100' each having a plurality of nozzles 102 arrayed in a two-dimensional fashion, to achieve a long dimension.

Figure 5:
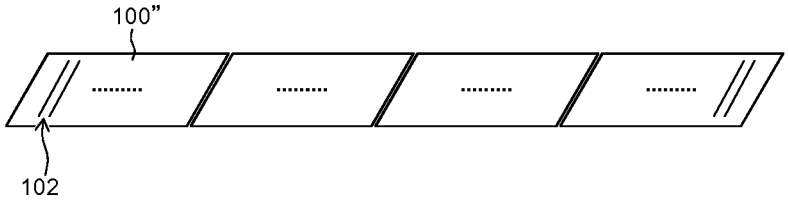
FIG. 5 is a plan view perspective diagram showing yet a further example of the composition of the inkjet head shown in FIG. 2.

Furthermore, as shown in FIG. 5, a line head may also be constituted by aligning in one row short head modules 100" which each do not cover the full width of the recording medium 14. In FIG. 5, the nozzles 102 arranged in the column direction (see FIG. 2) are indicated by the oblique solid lines.

Figure 6:
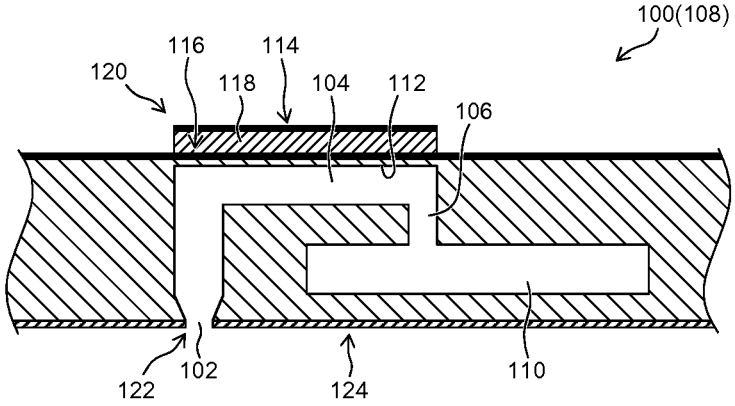
FIG. 6 is a cross-sectional diagram along line 6-6 in FIG. 2.

FIG. 6 is a cross-sectional diagram (a cross-sectional diagram along line 6-6 in FIG. 2) showing the structure of the head 100 (ink chamber unit 108) in FIG. 2.

The pressure chambers 104 which are connected to the nozzles 102 are linked via the supply ports 106 to a common flow channel 110. The common flow channel 110 is connected to an ink tank (not shown), which is a base tank that supplies ink, and the ink supplied from the ink tank is supplied through the common flow channel 110 to the pressure chambers 104.

A piezoelectric element 120 comprising an individual electrode 114 and a common electrode 116 and having a structure in which a piezoelectric body 118 is sandwiched between the individual electrode 114 and the common electrode 116 is bonded to the diaphragm 112 which constitutes the upper surface of the pressure chambers 104. Furthermore, the head 100 shown in FIG. 6 has a structure in which a nozzle plate 124 in which opening sections 122 of nozzles 102 are formed is bonded to a body in which a flow channel structure having the pressure chambers 104, supply ports 106, common flow channel 110, and the like, are formed.

The piezoelectric elements 120 and the diaphragm 112 deform when a prescribed drive voltage is applied between the individual electrodes 114 and the common electrode 116, and the volume of the pressure chambers 104 change accordingly. A pressure change occurs in the ink inside a pressure chamber 104 due to the volume change in the pressure chamber 104, and ink of a volume corresponding to the volume change in the pressure chamber 104 is ejected from the nozzle 102. After ejecting ink, when the piezoelectric element 120 and the diaphragm 112 return to their original state, new ink is filled into the pressure chamber 104 from the common flow channel 110 via the supply port 106.

In the present embodiment, the piezoelectric element 120 is used as an ink ejection force generating device, which causes the ink to be ejected from the nozzle 102 in the head 100; however, it is also possible to employ a thermal method in which a heater is provided inside the pressure chamber 104 and the ink is ejected by using the pressure of the film boiling action caused by the heating action of this heater.

Description of Control System

Figure 7:
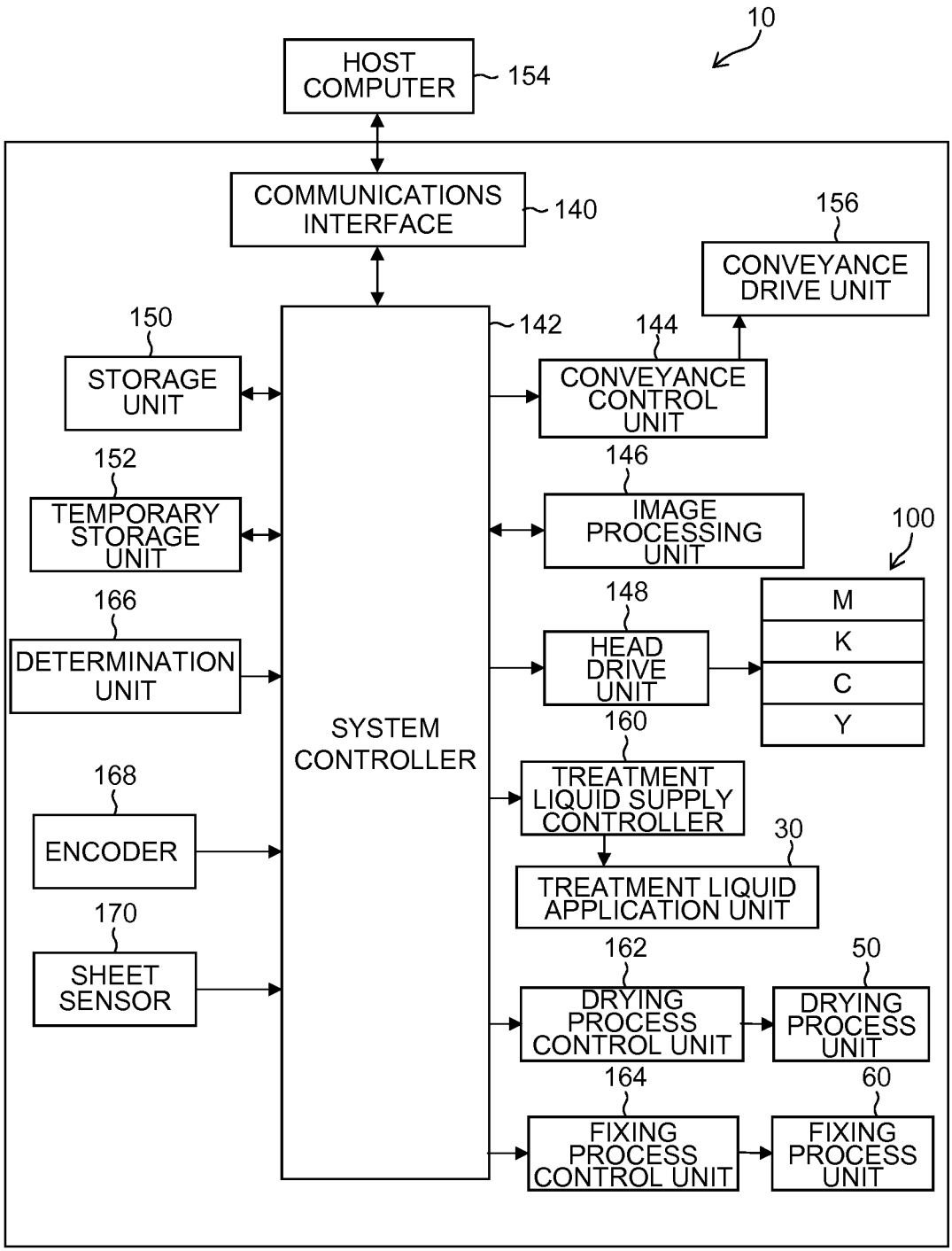
FIG. 7 is a principal block diagram showing the system composition of an inkjet recording apparatus.

FIG. 7 is a block diagram showing the approximate composition of the control system of the inkjet recording apparatus 10. The inkjet recording apparatus 10 comprises a communications interface 140, a system controller 142, a conveyance control unit 144, an image processing unit 146, and a head driving unit 148, as well as a storage unit (memory) 150 and a primary storage unit 152.

The communications interface 140 is an interface unit for receiving image data which is transmitted by a host computer 154. The communications interface 140 may employ a serial interface, such as a USB (Universal Serial Bus), or a parallel interface, such as a Centronics device. It is also possible to install a buffer memory (not illustrated) in the communications interface 140 for achieving high-speed communications.

The system controller 142 is constituted by a central processing unit (CPU) and peripheral circuits of same, and the like, and functions as a control apparatus which controls the whole of the inkjet recording apparatus 10 in accordance with a prescribed program, as well as functioning as a calculating apparatus which performs various calculations and also functioning as a memory controller for the storage unit 150 and the primary storage unit 152. In other words, the system controller 142 controls the various sections, such as the communications interface 140, the conveyance control unit 144, and the like, as well as controlling communications with the host computer 154 and read and writing to and from the storage unit 150 and the primary storage unit 152, and the like, and generating control signals which control the respective units described above.

The image data sent from the host computer 154 is input to the inkjet recording apparatus 10 via the communications interface 140, and prescribed image processing is carried out by the image processing unit 146.

The image processing unit 146 is a control unit which has signal (image) processing functions for carrying out various treatments, corrections and other processing in order to generate a signal for controlling printing from the image data, and which supplies the generated print data to the head drive unit 148. Required signal processing is carried out in the image processing unit 146 and the ejected droplet volume (droplet ejection volume) and the ejection timing of the head 100 are controlled via the head drive unit 148 on the basis of the image data. By this means, a desired dot size and dot arrangement are achieved. The head drive unit 148 shown in FIG. 7 may also include a feedback control system for maintaining uniform drive conditions in the head 100.

Furthermore, the conveyance control unit 144 controls the conveyance timing and conveyance speed of the recording medium 14 (see FIG. 1) on the basis of a print control signal generated by the image processing unit 146. The conveyance drive unit 156 in FIG. 7 includes motors which rotate the pressure drums 34, 44, 54, 64 in FIG. 1, motors which rotate the transfer drums 32, 42, 52, 62, a motor of the conveyance mechanism of the recording medium 14 in the paper supply unit 20, a motor which drives the tensioning roller 72A (72B) of the output unit 70, and the like, and the conveyance control unit 144 functions as a driver of the motors described above.

The storage unit 150 stores programs which is executed by the CPU of the system controller 142, and various data and control parameters, and the like, which are necessary for controlling the respective sections of the apparatus, and reading and writing of data are performed via the system controller 142. The storage unit 150 is not limited to a memory such as a semiconductor element, and may also employ a magnetic medium, such as a hard disk. Furthermore, the storage unit may also comprise an external interface and use a detachable storage medium.

The temporary storage unit (primary storage memory) 152 comprises the functions of a primary storage device for temporarily storing image data input via the communications interface 140, and the functions of a development area for various programs stored in the storage unit 150 and a calculation work area for the CPU (for example, a work area for the image processing unit 146). A volatile memory (RAM) which can be read from and written to sequentially is used as the temporary storage unit 152.

Moreover, the inkjet recording apparatus 10 comprises a treatment liquid application control unit 160, a drying process control unit 162 and a fixing process control unit 164, which respectively controls the operation of the respective sections of the treatment liquid application unit 30, the drying process device 56 (drying process unit 50), and the fixing process unit 60 including the heater 66 and the fixing roller 68 (see FIG. 1) in accordance with instructions from the system controller 142.

Based on the print data obtained from the image processor 146, the treatment liquid supply controller 160 controls the timing for supplying the treatment liquid, and also controls the supply amount of the treatment liquid. Although described in detail hereinafter, the treatment liquid application apparatus 36 provided in the treatment liquid application unit 30 has an application roller moving mechanism (indicated by a reference numeral 212 in FIG. 8) that moves an application roller (indicated by a reference numeral 210 in FIG. 8) so that the application roller can be brought into abutment (contact) with or separated from an impression cylinder (indicated by a reference numeral 34 in FIG. 1). The treatment liquid application apparatus 36 also has an anilox roller moving mechanism (indicated by a reference numeral 218 in FIG. 8) that moves an anilox roller (indicated by a reference numeral 216 in FIG. 8) for measuring the amount of treatment liquid fed to the application roller, so that the anilox roller can be brought into abutment (contact) with and separated from the application roller.

The treatment liquid supply controller 160 shown in FIG. 7 controls the timing for bringing the anilox roller and the application roller into abutment with each other and the timing for separating the anilox roller and the application roller, and also controls the timing for bringing the application roller and a recording medium (indicated by a reference numeral 14 in FIG. 1) into abutment with each other and the timing for separating the application roller and the recording medium.

The drying process control unit 162 controls the timing of the drying process, as well as controlling the process temperature, air flow volume, and the like, and the fixing process control unit 164 controls the temperature of the heater 66 as well as the application pressure of the fixing roller 68.

The determination unit 166 is a processing block which includes an in-line sensor 82 as shown in FIG. 1, and a signal processing unit for carrying out prescribed signal processing, such as noise removal, amplification, waveform shaping, and the like, of the read signal output from the in-line sensor 82. The system controller 142 judges the presence or absence of ejection abnormalities in the head 100 on the basis of the determination signal obtained by the determination unit 166.

An encoder 168 is mounted on each motor serving as a drive source for rotating the impression cylinders 34, 44, 54, 64, and outputs pulse signals corresponding to the rotation of each motor. By counting the number of pulse signals that are output from the encoder 168, the amount of rotation of each of the impression cylinders 34, 44, 54, 64 can be obtained. In addition, irregular rotation of each of the impression cylinders 34, 44, 54, 64 can be obtained based on frequency changes of the pulse signals output from the encoder 168.

In other words, a row of pulses output from the encoder 168 is subjected to predetermined signal processing, such as waveform shaping or noise rejection, and then sent to the system controller 142. Based on the row of pulses acquired from the encoder 168, the system controller 142 sends to the treatment liquid supply controller 160 command signals for controlling the abutment timing and separation timing of the application roller, as well as the abutment timing and separation timing of the anilox roller.

A sheet sensor 170 is a sensor provided in a conveyance path for the recording medium 14, and the position of the recording medium 14 on the conveyance path can be obtained based on detection results from the sheet sensor 170. For example, when the sheet sensor 170 provided in the vicinity of a gripper 80 of the impression cylinders 34 (44, 54, 64) detects the recording medium 14, the gripper 80 is operated to sandwich the front end part of the recording medium 14, and the state of the suction control or temperature control of the impression cylinder 34 is switched to a recording medium holding state.

In FIG. 7, one of the sheet sensors provided on the conveyance path for conveying the recording medium is denoted with a reference numeral 170 to represent the sheet sensors.

Although the present embodiment illustrates the inkjet recording apparatus 10 to which an impression cylinder conveyance method is applied, the method of conveying the recording medium 14 is not limited to such an impression cylinder conveyance method, and hence a belt conveyance method or other conveyance method of suctioning and holding a recording medium on a conveyance belt to convey the recording medium can be appropriately selected.

Explanation of Treatment Liquid Application Apparatus

Next, the treatment liquid application apparatus 36 that is applied to the treatment liquid application unit 30 shown in FIG. 1 is described in detail.

Figure 8:
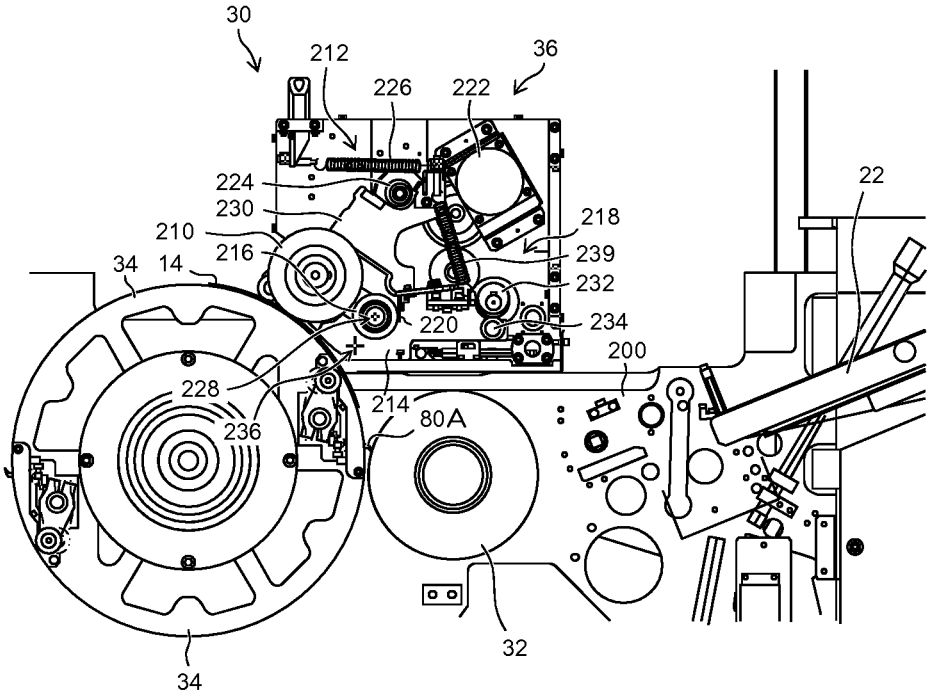
FIG. 8 is a partial enlarged diagram of a suction sheet showing the structure of a suction sheet relating to a first modification example.
Figure 9:
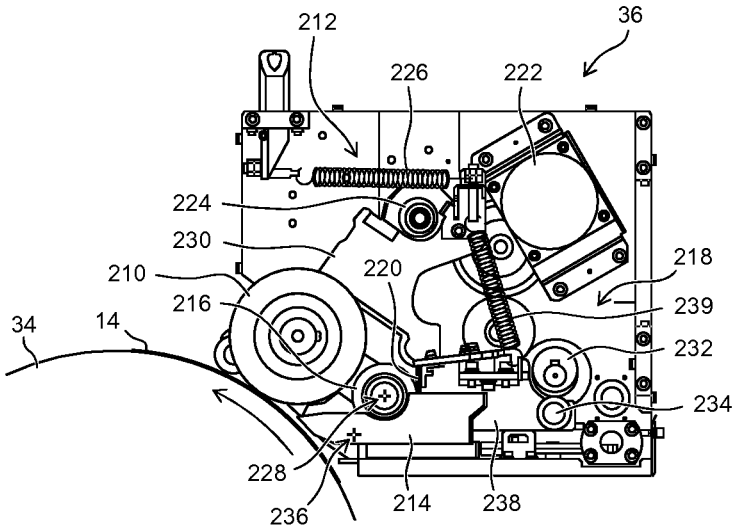
FIG. 9 is an enlarged view of a treatment liquid application apparatus shown in FIG. 8.

FIG. 8 is an enlarged view showing an enlargement of the treatment liquid application unit 30 shown in FIG. 1. FIG. 9 is an enlarged view showing an enlargement of the treatment liquid application unit 30 shown in FIG. 8. Note that the same reference numerals are used to indicate the parts same as or similar to those parts that are already described, and the descriptions of such parts are omitted accordingly.

As shown in FIG. 8, the treatment liquid application apparatus 36 is fixed to a frame unit 200 that supports the transfer cylinder 32 and the impression cylinder 34 in a rotatable manner, and is disposed in such a manner that the application roller 210 comes into contact the impression cylinder 34 at a position closer to the transfer cylinder 32 (the upstream side in terms of the recording medium conveyance direction) than to the highest position of the impression cylinder 34.

The treatment liquid application apparatus 36 shown in FIG. 8 includes: the application roller 210 which comes into contact with the recording medium and applies the treatment liquid while rotating at a predetermined rotational speed; the application roller moving mechanism 212 which changes an inter-axial distance between the application roller 210 and the circumferential surface of the impression cylinder 34; the anilox roller (measuring roller) 216 which measures the amount of treatment liquid accumulated on the liquid receiving dish 214, measures a certain amount of the treatment liquid while rotating at a predetermined rotational speed, and feeds the certain uniform amount of the treatment liquid to the application roller 210; the anilox roller moving mechanism 218 which changes an inter-axial distance between the application roller 210 and the anilox roller 216; and a blade 220 which scrapes off excess treatment liquid attached to the anilox roller 216.

The application roller 210 has a longitudinal length corresponding to the length in the axial direction of the impression cylinder 34 (the direction penetrating the paper surface in FIG. 8), and the treatment liquid can be applied over the entire surface of the recording medium 14 by moving the recording medium 14 once with respect to the application roller 210.

The application roller moving mechanism 212 includes an application roller separation cam 224 that rotates in accordance with the operation of a separation motor 222, an application roller nip spring 226 that generates a biasing force for bringing the application roller 210 into abutment with the impression cylinder 34, and an application roller separation arm 230 that supports the application roller 210 and rotates about an application roller separation center 228 (indicated by "+") in accordance with the operation of the application roller separation cam 224.

Furthermore, the anilox roller moving mechanism 218 includes an anilox arm separation cam 232 that rotates in accordance with the operation of the separation motor 222, a cam follower 234 that is operated in accordance with the operation of the anilox roller separation cam 232, an anilox roller separation arm 238 which is provided with the cam follower 234 and supports the anilox roller 216 and rotates about an anilox roller separation center 236 (indicated by "+") in accordance with the operation of the separation motor 222, and an anilox roller nip spring 239 that generates a biasing force for biasing the anilox roller 216 to the application roller 210.

The application roller 210 has acid-resistant properties and desirably is made of a rubber material having a hardness of 40° to 70°. Examples of the rubber material include EPDM (ethylene-propylene-diene rubber) and silicone rubber.

The anilox roller 216 has a lot of cells formed on the surface thereof (the cells have a recess shape in order to measure the amount of the treatment liquid), and is rotatably held while the lower haft thereof is immersed in the treatment liquid accumulated in the liquid receiving dish 214. When the anilox roller 216 is rotated, the treatment liquid stored in the liquid receiving dish 214 is scooped up. The excess treatment liquid attached to the surface of the anilox roller 216 is scraped off by the blade 220, and a constant amount of the treatment liquid held within the cells is fed to the application roller 210. A structure in which the surface of a stainless roller is carved or a structure in which the surface of a ceramics roller is laser-treated can be applied to the anilox roller 216. The rotational speed of the anilox roller 216 can be 70 to 150% of the rotational speed of the application roller 210, so that the condition of the liquid level can be improved and the application amount can be adjusted in accordance with the rotational speed.

As the material of the blade 220, an acid-resistant and abrasion-resistant material such as a resin material and rubber material, and a stainless material (an acid-resistant metallic material or metallic alloy) can be applied.

FIGS. 8 and 9 each illustrate a state during an application period in which the application roller 210 comes into abutment with the recording medium 14 and the anilox roller 216 comes into abutment with the application roller 210. In other words, during the application period, the application roller 210 is biased toward the impression cylinder 34 by the biasing force of the application roller nip spring 226, whereby the application roller 210 is in contact with the impression cylinder 34. Moreover, the anilox roller 216 is biased toward the application roller 210 by the biasing force of the anilox roller nip spring 239, whereby the anilox roller 216 is in contact with the application roller 210.

On the other hand, during a non-application period, the application roller 210 is separated from the impression cylinder 34 in order to avoid a collision between the gripper 80A (see FIG. 8) and the application roller 210. When the separation motor 222 is operated to rotate the application roller separation cam 224, the application roller separation arm 230 rotates in the clockwise direction of FIG. 9 about the application roller separation center 228 in accordance with the rotation of the application roller separation cam 224, whereby the application roller 210 separates from the impression cylinder 34 in accordance with the rotation of the application roller separation arm 230.

Furthermore, during the non-application period, the anilox roller 216 is separated from the application roller 210 to stop the treatment liquid from being fed. The treatment liquid that is not applied to the recording medium 14 and is a cause of the return liquid, is not fed to the application roller 210. The anilox roller separation cam 232 rotates in accordance with the operation of the separation motor 222, and the cam follower 234 rotates in accordance with the rotation of the anilox roller separation cam 232. The anilox roller separation arm 238 rotates in the clockwise direction of FIG. 9 about the anilox roller separation center 236, and consequently, the anilox roller 216 separates from the application roller 210.

The application roller 210 keeps rotating at its predetermined rotational speed even after separating from the impression cylinder 34. In addition, the anilox roller 216 keeps rotating at its predetermined rotational speed after separating from the application roller 210.

The treatment liquid application apparatus 36 illustrated in the present embodiment controls the start and discontinuation of the feeding of the treatment liquid from the anilox roller 216 to the application roller 210 in accordance with the timing for conveying the recording medium 14 and the length of the recording medium 14 in the conveyance direction (to be described as "the length of the recording medium" hereinafter). Abutment control and separation control between the application roller 210 and the anilox roller 216 are described hereinafter in detail.

Explanation of Abutment Control of Anilox Roller

Figure 10:
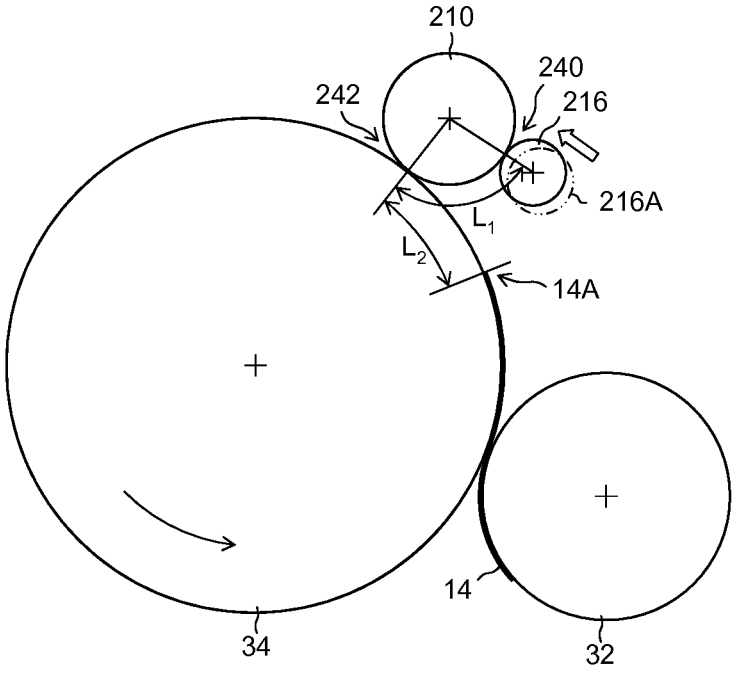
FIG. 10 is a diagram explaining the abutment timing of an anilox roller.

First, the abutment control (abutment timing) of the anilox roller 216 is described. FIG. 10 is a schematic diagram that schematically shows the timing for bringing the anilox roller 216 into abutment with the application roller 210.

The position in which the application roller 210 and the anilox roller 216 come into contact with each other when the treatment liquid is fed from the anilox roller 216 to the application roller 210 is referred to as a "feed processing position," which is indicated by a reference numeral 240. In addition, the position in which the application roller 210 and the recording medium 14 (the impression cylinder 34) come into contact with each other when the treatment liquid is applied from the application roller 210 to the recording medium 14 is referred to as an "application processing position," which is indicated by a reference numeral 242. In FIG. 10, the anilox roller that is separated from the application roller 210 is shown with a two-dot chain line with a reference numeral 216A. The direction shown by a white arrow indicates a moving (abutting) direction of the anilox roller 216.

Figure 16:
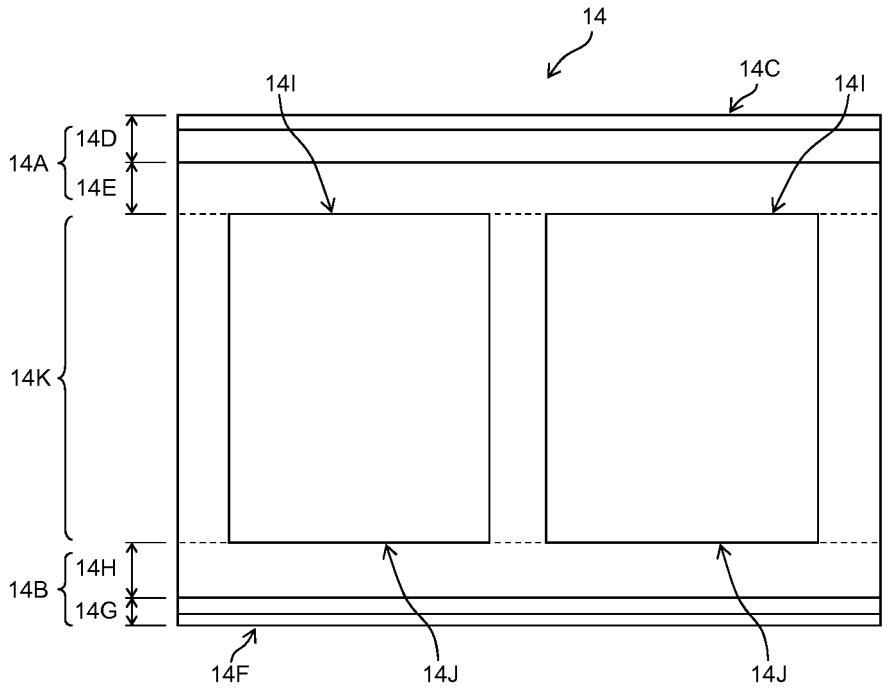
FIG. 16 is a diagram explaining a front end part and a rear end part of a recording medium.

The timing for bringing the anilox roller 216 into abutment with the application roller 210 (the timing for starting to feed the treatment liquid to the application roller 210) is determined at a timing at which the position of the application roller 210 performing the nipping with the anilox roller 216 reaches the front end part of the recording medium 14 (the front end part 14A of the recording medium) on the impression cylinder 34 in terms of the conveyance direction. "The front end part of the recording medium" here indicates an area between the lowermost stream end of the recording medium 14 in the conveyance direction and a position in which printing of an image (except for a test pattern, margin, and the like) is started. FIG. 16 shows the front end part 14A and rear end part 14B of the recording medium 14. As shown in FIG. 16, the front end part 14A of the recording medium 14 is an area that includes the front end test pattern area 14D in which the test pattern is formed from a front end 14C, and the front end margin 14E.

In other words, the timing for bringing the anilox roller 216 and the application roller 210 into abutment with each other is determined in such a manner that the treatment liquid feed starting position on the application roller 210 reaches the application processing position 242 when the front end part 14A of the recording medium 14 reaches the application processing position 242.

Specifically, the moving distance of the circumferential surface of the application roller 210 between the feed processing position 240 and the application processing position 242 is taken as $L_1$, and the moving distance of the front end part 14A of the recording medium 14 between the application processing position 242 and the position of the front end part 14A of the recording medium 14 (the moving distance of the circumferential surface of the impression cylinder 34) when the anilox roller 216 is brought into abutment with the application roller 210 is taken as $L_2$. The $L_2$ is obtained from the conveyance speed of the front end part 14A of the recording medium 14, and the timing for bringing the anilox roller 216 into abutment with the application roller 210 is determined in such a manner that the relation of $L_1=L_2$ is satisfied.

Note that when the application roller 210 and the anilox roller 216 are brought into abutment with each other, the rotation of the anilox roller separation cam 232 shown in FIG. 9 is started earlier than the timing for bringing the anilox roller 216 and the application roller 210 into abutment with each other, by the time taken until the anilox roller separation cam 232 is actually operated.

In this manner, feeding of the treatment liquid from the anilox roller 216 to the application roller 210 is started, and the application processing for applying the treatment liquid to the recording medium 14 is executed by bringing the application roller 210 into abutment with the recording medium 14 at the timing when the front end part 14A of the recording medium 14 reaches the application processing position 242.

In order to improve the accuracy of the position in which the application roller 210 and the anilox roller 216 are brought into abutment, as well as the accuracy of the timing for bringing the application roller 210 and the anilox roller 216 into abutment with each other, the timing for bringing the application roller 210 and the anilox roller 216 into abutment with each other may be corrected with reference to an output of the encoder (indicated by reference numeral 168 in FIG. 7) that is mounted on the impression cylinder 34 or a motor for driving the impression cylinder 34.

In other words, the moving speed of the recording medium 14 (the rotational speed of the impression cylinder 34), speed variation of the recording medium 14 (the impression cylinder 34), and the position of the recording medium 14 on the conveyance path are grasped based on an output pulse of the encoder. The timing for starting the operation of the anilox separation cam 232 can be corrected using these information items.

The timing for bringing the application roller 210 and the anilox roller 216 into abutment with each other can also be corrected so that the treatment liquid is applied onto the recording medium 14 from the position which is posterior to the front end part 14A by the grip margin held by the gripper (illustrated with reference numeral 80A in FIG. 8).

Explanation of Separation Control of Anilox Roller

Figure 11:
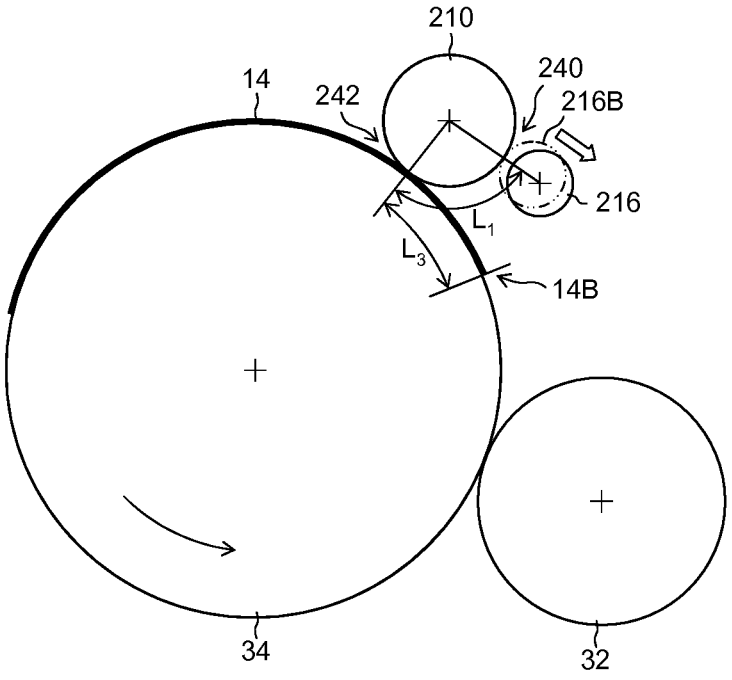
FIG. 11 is a diagram explaining the separation timing of the anilox roller.

The separation control (separation timing) of the anilox roller 216 is described next. FIG. 11 is a schematic diagram schematically showing the timing for separating the anilox roller 216 from the application roller 210. In FIG. 11, the anilox roller abutting with the application roller 210 is shown with a two-dot chain line with a reference numeral 216B. The direction shown by a white arrow indicates a moving (separating) direction of the anilox roller 216.

The timing for separating the anilox roller 216 from the application roller 210 is determined in such a manner that the anilox roller 216 separates from the application roller 210 at a timing at which the application roller 210 performing the nipping with the anilox roller 216 reaches the rear end part 14B of the recording medium 14 on the impression cylinder 34. "The rear end part of the recording medium" here indicates an area between the uppermost stream end of the recording medium 14 in terms of the conveyance direction and a position in which printing of the image (except for the test pattern, margin, and the like) is ended. As shown in FIG. 16, the rear end part of the recording medium is an area that includes a rear end test pattern area 14G of the recording medium 14 in which the test pattern is formed from the rear end 14F, and a rear end margin 14H of the recording medium 14. Specifically, the recording medium 14 is divided into the front end part 14A, the rear end part 14B, and an image recording area 14K between an image recording starting position 14I and an image recording ending position 14J.

Specifically, the moving distance of the recording medium 14 moving between the application processing position 242 and the position of the rear end part 14B of the recording medium 14 at the timing when the anilox roller 216 is separated from the application roller is taken as $L_3$. The $L_3$ is obtained from the conveyance speed of the rear end part 14B of the recording medium 14, and the timing for separating the anilox roller 216 from the application roller 210 is determined in such a manner that the relation of $L_1=L_3$ is satisfied. Note that the relation of $L_3=L_2$ is satisfied when the rotational speed of the impression cylinder 34 and the rotational speed of the application roller 210 do not change.

Desirably, as with the abutment timing of the anilox roller 216, the rotation of the anilox roller separation cam 232 is started earlier than the separation timing of the anilox roller 216 by the time taken for the anilox roller separation cam 232 to be operated. Also, desirably, speed variation of the recording medium 14 and the position of the recording medium 14 on the conveyance path are grasped based on an output pulse of the above-described encoder, and that the separation timing of the anilox roller 216 and the separation timing of the application roller 210 are corrected using these information items.

Furthermore, in order to cope with positional variation of the rear end part 14B of the recording medium 14 due to variation in length of the recording medium 14, the timing for starting to rotate the anilox roller separation cam 232 is corrected in such a manner that the rotation of the anilox roller separation cam 232 is started at the section before the rear end part 14B of the recording medium 14 by the length correspond to the variation in length of the recording medium 14.

The size of the recording medium 14 needs to be grasped in order to grasp the position of the rear end part 14B of the recording medium 14. In order to grasp the size of the recording medium 14, for example, the types and specifications (the minimum value of the length) of the recording media 14 can be stored in the form of a data table beforehand, and acquired information on the types of the recording media 14 can be referenced. The type information of the recording medium 14 can be applied in a method of reading the type information from an information storage medium, such as an IC tag, attached to each recording medium 14 when the recording media 14 is loaded onto a paper supply unit 20, a method of allowing an operator to input the type information via a user interface, and a method of actually measuring the size of each recording medium 14.

In the present embodiment, an aspect in which the speed variation of the recording medium 14 or the position thereof on the conveyance path is grasped based on the information that is obtained from the encoder (rotating detector) mounted in the impression cylinder 34 conveying the recording medium 14 in the processing area of the treatment liquid application apparatus 36 or in the motor driving the impression cylinder 34, is described as an example. However, the speed variation of the recording medium 14 or the position thereof on the conveyance path can be also grasped based on the information that is obtained not from the encoder but from a linear scale (a linear detector) provided in the vicinity of the conveyance path. In addition, the rotational speed of the impression cylinder 34 can be presumed based on the rotational speeds of the other impression cylinders 44, 54, 64 (see FIG. 1).

According to the treatment liquid application apparatus 36 configured as described above, the inter-axial distance between the anilox roller 216 and the application roller 210 is controlled such that the anilox roller 216 is brought into abutment with the application roller 210 at the position in which the application roller 210 corresponds to the front end part 14A of the recording medium 14. Therefore, the treatment liquid that is not applied to the recording medium 14 is not supplied to the application roller 210, whereby uneven application of the treatment liquid caused by the difference between the circumferential length of the application roller 210 and the length of the recording medium 14 can be prevented. As a result, the treatment liquid can be applied to the recording medium 14 evenly.

Because the movement of the anilox roller 216 is controlled so as to adjust the nipping position on the application roller 210 between the application roller 210 and the anilox roller 216 in such a manner that the anilox roller 216 is brought into abutment with the application roller 210 at the timing when the position of the front end part 14A of the recording medium 14 on the impression cylinder 34 reaches, the relative position between the impression cylinder 34 and the application roller 210 does not change when the anilox roller 216 comes into abutment with the application roller 210, and thus the treatment liquid can be applied uniformly to the recording medium 14. In other words, the movement of the anilox roller 216 to abut against the application roller 210 is controlled in such a manner that the position on the application roller 210 where the anilox roller 216 makes contact with the application roller 210 corresponds to the position of the front end part 14A of the recording medium 14 on the impression cylinder 34, and therefore, with respect to the abutment position between the application roller 210 and the impression cylinder 34, the distance $L_1$ from the position on the application roller 210 where the anilox roller 216 makes contact with the application roller 210 and the distance $L_2$ from the position of the front end part 14A of the recording medium 14 on the impression cylinder 34 is the same.

The inter-axial distance between the impression cylinder 34 and the application roller 210 is controlled such that the application roller 210 is brought into abutment with the recording medium 14 at the position in which the application roller 210 corresponds to the front end part 14A of the recording medium 14. Therefore, a collision between the application roller 210 and the gripper 80A provided in the impression cylinder 34 can be prevented from happening, and, as a result, the durability of the application roller 210 can be improved.

The inter-axial distance between the application roller 210 and the anilox roller 216 is controlled such that the anilox roller 216 separates from the application roller 210 at the position in which the application roller 210 corresponds to the rear end part 14B of the recording medium 14. Therefore, uneven application of the treatment liquid caused by the difference between the circumferential length of the application roller 210 and the length of the recording medium 14 can be prevented, because the treatment liquid that is not applied to the recording medium 14 is not supplied to the application roller 210. As a result, the treatment liquid can be applied to the recording medium 14 evenly.

Because the movement of the anilox roller 216 is controlled such that the position on the application roller 210 in which the application roller 210 and the anilox roller 216 nip with each other separates the anilox roller 216 from the application roller 210 at the position of the rear end part 14B of the recording medium 14 on the impression cylinder 34, the relative position between the impression cylinder 34 and the application roller 210 does not change when the anilox roller 216 is separated from the application roller 210, and thus the treatment liquid can be applied uniformly to the recording medium 14. In other words, the movement of the anilox roller 216 to separate from the application roller 210 is controlled in such a manner that the position on the application roller 210 where the anilox roller 216 separates from the application roller 210 corresponds to the position of the rear end part 14B of the recording medium 14 on the impression cylinder 34, and therefore, with respect to the abutment position between the application roller 210 and the impression cylinder 34, the distance $L_1$ from the position on the application roller 210 where the anilox roller 216 separates from the application roller 210 and the distance $L_3$ from the position of the rear end part 14B of the recording medium 14 on the impression cylinder 34 is the same.

The inter-axial distance between the impression cylinder 34 and the application roller 210 is controlled such that the application roller 210 separates from the recording medium 14 at the position in which the application roller 210 corresponds to the rear end part 14B of the recording medium 14. Thus, the application roller 210 is prevented from coming into contact with the impression cylinder 34 that does not hold the recording medium 14, so that the application roller 210 and the impression cylinder 34 are prevented from becoming dirty.

FIRST MODIFIED EXAMPLE

Figure 12:
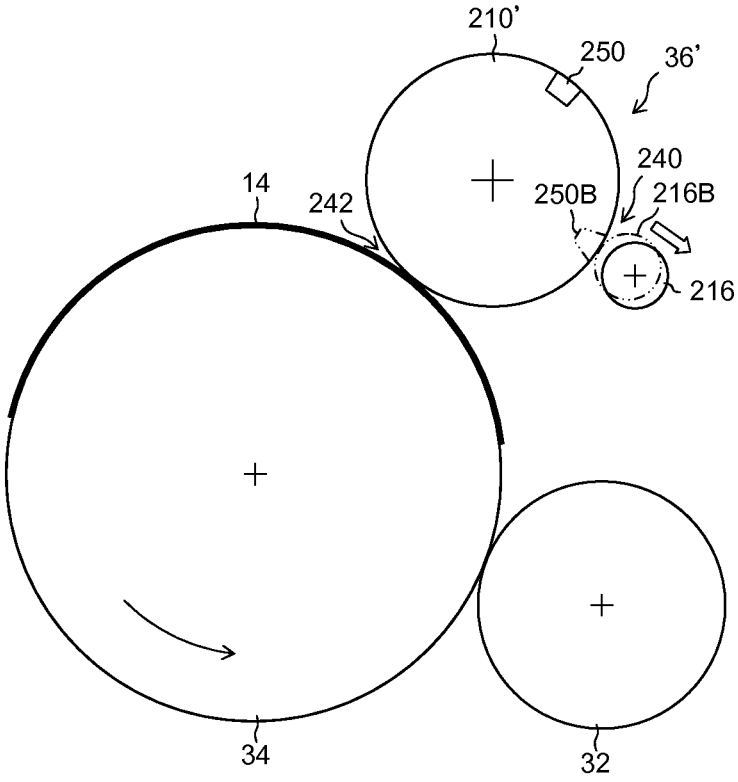
FIG. 12 is a block diagram of an application apparatus according to a first modified example of an embodiment of the present invention.

A first modified example according to the present embodiment is described next. FIG. 12 is a block diagram showing a schematic configuration of a treatment liquid application apparatus 36' according to the first modified example, wherein the transfer cylinder 32 and impression cylinder 34 conveying the recording medium 14 are illustrated.

The circumferential length of the application roller 210 is ½ of the circumferential length of the impression cylinder 34 and corresponds to a half of the circumferential length of the impression cylinder 34. Because the impression cylinder 34 has a structure where a single recording medium 14 is held on a region of the half circumference of the impression cylinder 34, the treatment liquid can be applied to the entire surface of the recording medium 14 having the maximum size, when the application roller 210 rotates once.

As shown in FIG. 12, a recess part 250 in the axial direction (the direction penetrating the paper surface of FIG. 12) is provided on the circumferential surface of an application roller 210' provided in the treatment liquid application apparatus 36'. The length of the recess part 250 in the axial direction corresponds to the length of the recording medium 14 in the width direction (the direction substantially perpendicular to the conveyance direction).

The application roller 210' rotates at the same circumferential speed as the impression cylinder 34. When the anilox roller 216 approaches the application roller 210' at a timing when the recess part 250 reaches the feed processing position 240, the anilox roller 216 is brought into abutment with the application roller 210' immediately after the recess part 250 passes through the feed processing position 240, and supply of the treatment liquid to the application roller 210' is started.

The position in which the anilox roller 216 is brought into abutment with the application roller 210' may be within a range corresponding to the width of the recess part 250 (the length of a circumferential surface direction), and the accuracy of positioning the application roller 210' and the anilox roller 216 is relaxed. When bringing the application roller 210' into abutment with the recording medium 14, the front end part 14A of the recording medium 14 may fall within the range of the width of the recess part 250, and the accuracy of positioning the application roller 210' and the recording medium 14 is relaxed.

In FIG. 12, in a state where the anilox roller is brought into abutment with the application roller 210', the anilox roller is indicated by a reference numeral 216B, and the recess part is indicated by a reference numeral 250B. The anilox roller 216B and the recess part 250B are shown with two-dot chain lines.

According to the treatment liquid application apparatus 36' of the first modified example, the accuracy of positioning the application roller 210' and the anilox roller 216 is relaxed, and the accuracy of positioning the application roller 210' and the recording medium 14 is also relaxed. Even when high speed conveyance of a recording medium 14 (high speed rotation of the application roller 210') is performed, therefore, the apparatus can apply the treatment liquid onto the recording medium 14 properly.

SECOND MODIFIED EXAMPLE

Figure 13:
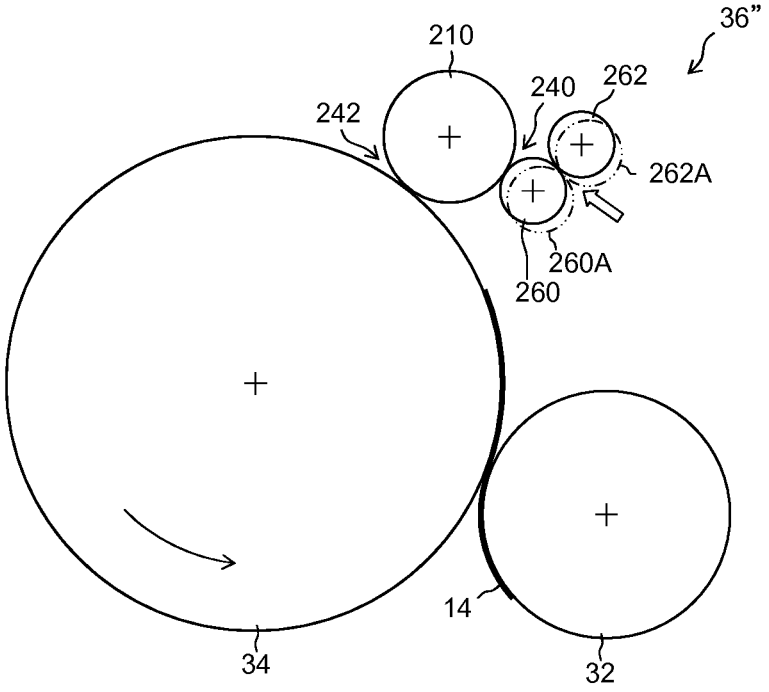
FIG. 13 is a block diagram of an application apparatus according to a second modified example of an embodiment of the present invention.
Figure 14A:
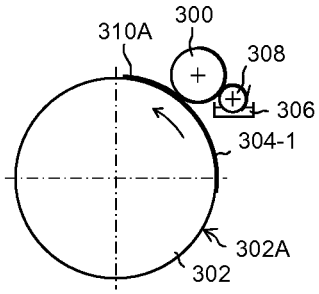
FIG.14A RELATED ART
FIGS. 14A to 14D are diagrams explaining a roller application method according to the related art.
Figure 14B:
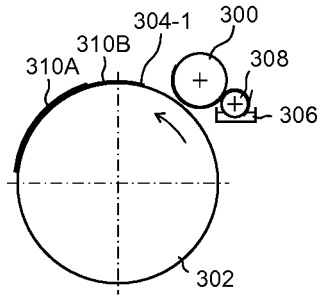
FIG.14B RELATED ART
Figure 14C:
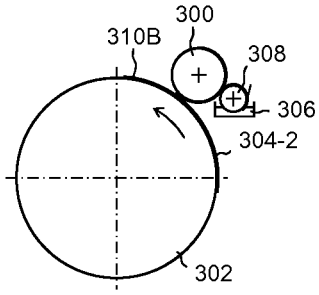
FIG.14C RELATED ART
Figure 14D:
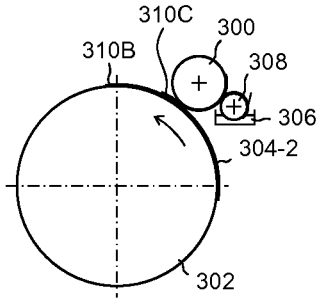
FIG.14D RELATED ART
Figure 15:
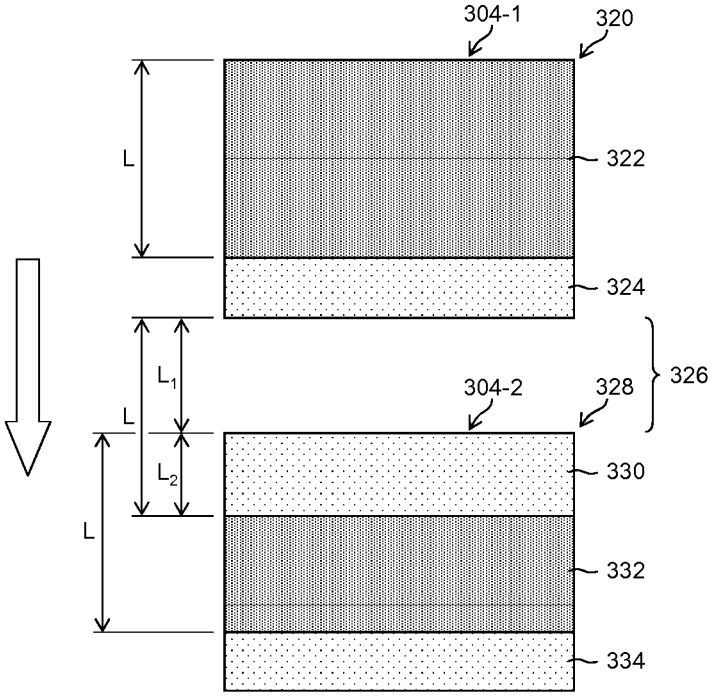
FIG.15 RELATED ART
FIG. 15 is a diagram explaining the uneven application caused by the roller application method according to the related art.

A second modified example of the present embodiment is described next. FIG. 13 is a block diagram showing a schematic configuration of a treatment liquid application apparatus 36" according to the second modified example. The treatment liquid application apparatus 36" includes an abrasive roller 260 and a squeezing roller 262, in place of the anilox roller (see FIG. 10) functioning as a feed roller and measuring roller of the application roller 210. As the abrasive roller 260, a stainless roller or ceramics roller, the surface of which is polished, is employed, and the treatment liquid that is scooped up is held on the polished surface. The squeezing roller 262, in place of the blade (indicated by a reference numeral 220 in FIG. 8), functions to control the amount of treatment liquid held on the surface of the abrasive roller 260, and a rubber material such as NBR (nitrile rubber) is employed as the squeezing roller 262.

In the aspect shown in FIG. 13, the abrasive roller 260 is brought into abutment with the application roller 210 when the treatment liquid is fed to the application roller 210, and then the abrasive roller 260 is separated from the application roller 210 when stopping the supply of the treatment liquid to the application roller 210. The squeezing roller 262 is configured to move integrally with the abrasive roller 260. In FIG. 13, two-dot chain lines illustrate a state in which the abrasive roller 260 separates from the application roller 210, and in this state, the abrasive roller is indicated by a reference numeral 260A and the squeezing roller is indicated by a reference numeral 262A.

According to the second modified example, various configurations can be applied to the feed roller (measuring roller) that feeds a certain uniform amount of the treatment liquid to the application roller 210.

Example of Application to other Apparatus Compositions

In the embodiment described above, the inkjet recording apparatus has been described as an example of an image forming apparatus, but the scope of application of the present invention is not limited to this, and may also be applied to an image forming apparatus based on a method other than an inkjet method, such as a laser recording method or electrophotographic method, or the like. For example, it is also possible to apply the present invention to color image recording apparatuses of various types, such as a thermal transfer recording apparatus equipped with a recording head that uses thermal elements as recording elements, an LED electrophotographic printer equipped with a recording head having LED elements as recording elements, or a silver halide photographic printer having an LED line type exposure head, or the like.

Furthermore, the meaning of the term "image forming apparatus" is not restricted to a so-called graphic printing application for printing photographic prints or posters, but rather also encompasses industrial apparatuses which are able to form patterns that may be perceived as images, such as resist printing apparatuses, wire printing apparatuses for electronic circuit substrates, ultra-fine structure forming apparatuses, or the like.

Appendix

As has become evident from the detailed description of the embodiments given above, the present specification includes disclosure of various technical ideas described below.

One aspect of the invention is directed to an application apparatus comprising: a medium conveying device which holds and conveys a medium in a predetermined conveyance direction; an application roller which applies a liquid to the medium held by the medium conveying device; an application roller rotating device which rotates the application roller at a predetermined rotational speed; a measuring roller which feeds a predetermined measured amount of the liquid to the application roller; a measuring roller rotating device which rotates the measuring roller at a predetermined rotational speed; a first moving device which causes relative movement between the application roller and the medium conveying device to change a distance between the application roller and the medium conveying device; a second moving device which causes relative movement between the application roller and the measuring roller to change a distance between the application roller and the measuring roller; and a movement controlling device which controls the second moving device in such a manner that, when the application roller and the medium are brought into abutment with each other from a state in which the application roller and the medium are separated from each other, a front end part of the medium in terms of the conveyance direction abuts with an abutment position on a circumferential surface of the application roller when the application roller and the measuring roller are brought into abutment with each other from a state in which the application roller and the measuring roller are separated from each other.

According to this aspect of the invention, when the application roller and the measuring roller are brought into contact with each other from a state in which the application roller and the measuring roller are separated, the measuring roller is brought into abutment with a position of the application roller in which the application roller abuts with the front end part of the medium in the conveyance direction. Thus, at the time of non-application, the liquid is not fed to the application roller, and return liquid that is not fed to the medium is prevented from occurring, whereby the uneven application caused by the return liquid is prevented.

The medium moving device can include an impression cylinder that is in the form of a drum and rotates while holding a medium on the circumferential surface thereof, to convey the medium.

The first moving device may move the application roller with respect to the fixed medium conveying device, or may move the medium conveying device with respect to the fixed application roller. As an example where the impression cylinder conveyance method is applied to the medium conveying device, the inter-axial distance between the application roller and the impression cylinder can be changed.

Specific examples of the first moving device include an application roller moving device that moves the application roller with respect to the medium conveying device.

The second moving device may move the measuring roller with respect to the fixed application roller, or may move the application roller with respect to the fixed measuring roller. Moreover, in one aspect of the second moving device, the inter-axial distance between the application roller and the measuring roller can be changed. Specific examples of the second moving device include a measuring roller moving device that moves the measuring roller.

The present invention may be applied to media such as papers, resin sheets, metallic sheets, and other sheet-like media of various types and materials. Examples of the medium according to the present invention may include media called "recording medium" or "recording media."

Desirably, the movement controlling device controls the first moving device so as to bring the front end part of the medium in terms of the conveyance direction into contact with the abutment position on the circumferential surface of the application roller in which the application roller and the measuring roller are brought into abutment with each other.

According to this aspect, the feed starting position for feeding the liquid to the application roller by means of the measuring roller is brought into abutment with the front end part of the medium, whereby the liquid is applied evenly starting from the front end part of the medium.

"The front end part of the medium" includes at least an end (front end) on the downstream side in the conveyance direction of the medium and corresponds to an area that has a predetermined length from the front end in the conveyance direction.

Desirably, when a moving distance of the circumferential surface of the application roller from the abutment position in which the application roller and the measuring roller are brought into abutment with each other to an abutment position in which the application roller and the medium are brought into abutment with each other, is taken as $L_1$, and when a moving distance of the front end part of the medium from a position of the front end part of the medium when the application roller and the measuring roller are brought into abutment with each other, to a position of the front end part of the medium in which the application roller and the medium are brought into abutment with each other, is taken as $L_2$, the movement controlling device controls an operation timing of the first moving device and an operation timing of the second moving device so that a relationship of $L_1=L_2$ is satisfied.

In this aspect, it is preferred that the conveyance speed of the recording medium be substantially the same as the circumferential speed of the application roller.

Desirably, the movement controlling device controls the second moving device so as to separate the application roller and the measuring roller from each other when an abutment position on the circumferential surface of the application roller which is brought into abutment with a rear end part of the medium in the conveyance direction reaches the abutment position in which the application roller and the measuring roller are brought into abutment with each other.

According to this aspect, the application roller and the measuring roller are separated from each other in accordance with the rear end part of the medium, whereby the supply of the liquid to the application roller is stopped at the time of non-application, and the occurrence of the return liquid is prevented.

The rear end part of the medium includes at least an end (rear end) on the upstream side in the conveyance direction of the medium and corresponds to an area that has a predetermined length from the rear end in the conveyance direction.

Desirably, the movement controlling device controls the first moving device so as to separate the medium conveying device and the application roller from each other when a rear end part of the medium in the conveyance direction reaches an abutment position in which the medium and the application roller are brought into abutment with each other.

According to this aspect, after the medium passes through the liquid application position of the application roller, the application roller is separated so that the application of the liquid is stopped. As a result, the medium conveying device is prevented from becoming dirty. In addition, according to an example of this aspect where a sandwiching member for sandwiching an end of the medium is provided, a collision between the application roller and the sandwiching member is prevented.

Desirably, when a moving distance of the circumferential surface of the application roller from the abutment position in which the application roller and the measuring roller are brought into abutment with each other to an abutment position in which the application roller and the medium are brought into abutment with each other, is taken as $L_1$, and when a moving distance of a rear end part of the medium from the position of the rear end part of the medium at timing of when the application roller and the measuring roller are brought into abutment with each other, to the abutment position in which the application roller and the medium are brought into abutment with each other, is taken as $L_3$, the movement controlling device controls an operation timing of the first moving device and an operation timing of the second moving device so that a relationship of $L_1=L_3$ is satisfied.

The moving distance $L_3$ of the rear end part of the medium according to this aspect and the moving distance $L_2$ of the front end part of the medium described in the above have a relationship of $L_2=L_3$ when there is no fluctuation in the conveyance speed of the medium.

In order to attain an object described above, another aspect of the present invention is directed to an application apparatus comprising: a medium conveying device which holds and conveys a medium in a predetermined conveyance direction;

an application roller which applies a liquid to the medium held by the medium conveying device; an application roller rotating device which rotates the application roller at a predetermined rotational speed; a measuring roller which feeds a predetermined measured amount of the liquid to the application roller; a measuring roller rotating device which rotates the measuring roller at a predetermined rotational speed; a first moving device which causes relative movement between the application roller and the medium conveying device to change a distance between the application roller and the medium conveying device; a second moving device which causes relative movement between the application roller and the measuring roller to change a distance between the application roller and the measuring roller; and a movement controlling device which controls the second moving device so as to separate the application roller and the measuring roller from each other when an abutment position on a circumferential surface of the application roller which is brought into abutment with a rear end part of the medium in the conveyance direction reaches an abutment position in which the application roller and the measuring roller are brought into abutment with each other.

In this aspect, the first moving device is controlled such that the medium conveying device and the application roller are separated from each other when the rear end part of the medium in the conveyance direction reaches the position in which the medium and the application roller are brought into abutment with each other.

Desirably, the movement controlling device controls the second moving device in such a manner that, when the application roller and the medium are brought into abutment with each other from a state in which the application roller and the medium are separated from each other, a front end part of the medium in the conveyance direction abuts with the abutment position on the circumferential surface of the application roller in which the application roller and the measuring roller are brought into abutment with each other from a state in which the application roller and the measuring roller are separated from each other.

It is preferred that such an aspect control the second moving device such that the application roller and the measuring roller are separated from each other when the position on the circumferential surface of the application roller in which the application roller and the rear end part in the conveyance direction of the medium are brought into abutment with each other reaches the position in which the application roller and the measuring roller are brought into abutment with each other.

Desirably, the application apparatus further comprises a measuring device which measures a fluctuation of a conveyance speed of the medium, wherein the movement controlling device corrects timing of when the application roller and the medium are brought into abutment with each other in accordance with the fluctuation of the conveyance speed of the medium which is measured by the measuring device, to control the first moving device.

According to this aspect, because the operation timing of the first moving device is corrected in accordance with the fluctuation of the conveyance speed of the medium, the application of the liquid is started reliably from the front end part of the medium.

Moreover, an aspect is possible in which the timing for bringing the application roller and the measuring roller into abutment with each other in accordance with the fluctuation in the conveyance speed of the medium is corrected.

Desirably, the application roller has a recess part extending in an axial direction, and the movement controlling device controls the first moving device so as to bring the recess part and the measuring roller into abutment with each other when the application roller and the measuring roller are brought into abutment with each other from a state in which the application roller and the measuring roller are separated from each other.

According to this aspect, the front end part of the medium may be positioned in a range corresponding to the length of the recess part in the conveyance direction, and the accuracy of the position in which the medium and the application roller are brought into abutment with each other and the accuracy of the timing for bringing the medium and the application roller into abutment with each other are relaxed.

Such an aspect is particularly effective when the medium is conveyed at high speed.

Desirably, the movement controlling device controls the second moving device so as to bring the recess part into contact with the front end part of the medium in the conveyance direction.

According to this aspect, the accuracy of the position in which the application roller and the measuring roller are brought into abutment with each other and the accuracy of the abutment timing thereof are relaxed.

In order to attain an object described above, another aspect of the present invention is directed to an image forming apparatus comprising: a medium conveying device which holds and conveys a medium in a predetermined conveyance direction; an application roller which applies, to the medium held by the medium conveying device, a treatment liquid functioning to aggregate or insolubilize an ink; an application roller rotating device which rotates the application roller at a predetermined rotational speed; a measuring roller which feeds a uniform amount of the treatment liquid to the application roller; a measuring roller rotating device which rotates the measuring roller at a predetermined rotational speed; a first moving device which causes relative movement between the application roller and the medium conveying device to change a distance between the application roller and the medium conveying device; a second moving device which causes relative movement between the application roller and the measuring roller to change a distance between the application roller and the measuring roller; a movement controlling device which controls the second moving device in such a manner that, when the application roller and the medium are brought into abutment with each other from a state in which the application roller and the medium are separated from each other, a front end part of the medium in the conveyance direction abuts with an abutment position on a circumferential surface of the application roller in which the application roller and the measuring roller are brought into abutment with each other from a state in which the application roller and the measuring roller are separated from each other; and an image forming device which forms an image on the medium to which the treatment liquid has been applied.

The inkjet recording apparatus which is one mode of the image forming apparatus according to the present invention includes: a liquid ejection head (recording head) in which a plurality of liquid droplet ejection elements are arranged at high density, each liquid droplet ejection element having a nozzle (ejection port) for ejecting an ink droplet in order to form a dot and a pressure generating device (piezoelectric element or heating element for heating for bubble generation) which generates an ejection pressure; and an ejection control device which controls the ejection of liquid droplets from the liquid ejection head on the basis of ink ejection data (dot image data) generated from an input image. An image is formed on a recording medium by means of the liquid droplets ejected from the nozzles.

For example, color conversion and halftone processing are carried out on the basis of the image data (print data) input through the image input device, and ink ejection data corresponding to the ink colors is generated. The driving of the pressure generating elements corresponding to the respective nozzles of the liquid ejection head is controlled on the basis of this ink ejection data, and ink droplets are ejected from the nozzles.

In order to achieve high-resolution image output, a desirable mode is one using a recording head in which a large number of liquid droplet ejection elements (ink chamber units) are arranged at high density, each liquid droplet ejection element having a nozzle (ejection port) which ejects ink liquid, a pressure chamber corresponding to the nozzle, and a pressure generating device.

A compositional example of a recording head based on an inkjet method of this kind is a full line type head having a nozzle row in which a plurality of ejection ports (nozzles) are arranged through a length corresponding to the full width of the recording medium. In this case, a mode may be adopted in which a plurality of relatively short ejection head modules having nozzles rows which do not reach a length corresponding to the full width of the recording medium are combined and joined together, thereby forming nozzle rows of a length that correspond to the full width of the recording medium.

A full line type head is usually disposed in a direction that is perpendicular to the relative feed direction (relative conveyance direction) of the recording medium, but a mode may also be adopted in which the head is disposed following an oblique direction that forms a prescribed angle with respect to the direction perpendicular to the conveyance direction.

The conveyance device for causing the recording medium and the recording head to move relative to each other may include a mode where the recording medium is conveyed with respect to a stationary (fixed) head, or a mode where a head is moved with respect to a stationary recording medium, or a mode where both the head and the recording medium are moved. When forming color images by means of an inkjet recording head, it is possible to provide a recording head for each color of a plurality of colored inks (recording liquids), or it is possible to eject inks of a plurality of colors, from one recording head.

The term "recording medium" includes various types of media, irrespective of material and size, such as continuous paper, cut paper, sealed paper, resin sheets, such as OHP sheets, film, cloth, a printed circuit board on which a wiring pattern, or the like, is formed, and an intermediate transfer medium, and the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An application apparatus comprising:

a medium conveying device which holds and conveys a medium in a predetermined conveyance direction;

an application roller which applies a liquid to the medium held by the medium conveying device;

an application roller rotating device which rotates the application roller at a predetermined rotational speed;

a measuring roller which feeds a predetermined measured amount of the liquid to the application roller;

a measuring roller rotating device which rotates the measuring roller at a predetermined rotational speed;

a first moving device which causes relative movement between the application roller and the medium conveying device to change a distance between the application roller and the medium conveying device;

a second moving device which causes relative movement between the application roller and the measuring roller to change a distance between the application roller and the measuring roller; and a movement controlling device configured to control the second moving device in such a manner that, when the application roller and the medium are brought into abutment with each other from a state in which the application roller and the medium are separated from each other, a front end part of the medium in terms of the conveyance direction abuts with an abutment position on a circumferential surface of the application roller when the application roller and the measuring roller are brought into abutment with each other from a state in which the application roller and the measuring roller are separated from each other, wherein, when a moving distance of the circumferential surface of the application roller from the abutment position in which the application roller and the measuring roller are brought into abutment with each other to an abutment position in which the application roller and the medium are brought into abutment with each other, is taken as $L_1$, and when a moving distance of the front end part of the medium from a position of the front end part of the medium when the application roller and the measuring roller are brought into abutment with each other, to a position of the front end part of the medium in which the application roller and the medium are brought into abutment with each other, is taken as $L_2$, the movement controlling device is configured to control an operation timing of the first moving device and an operation timing of the second moving device in such a manner that a relationship of $L_1=L_2$ is satisfied.

2. The application apparatus as defined in claim 1, wherein the movement controlling device is configured to control the first moving device so as to bring the front end part of the medium in terms of the conveyance direction into contact with the abutment position on the circumferential surface of the application roller in which the application roller and the measuring roller are brought into abutment with each other.

3. An application apparatus comprising:

a medium conveying device which holds and conveys a medium in a predetermined conveyance direction;

an application roller which applies a liquid to the medium held by the medium conveying device;

an application roller rotating device which rotates the application roller at a predetermined rotational speed;

a measuring roller which feeds a predetermined measured amount of the liquid to the application roller;

a measuring roller rotating device which rotates the measuring roller at a predetermined rotational speed;

a first moving device which causes relative movement between the application roller and the medium conveying device to change a distance between the application roller and the medium conveying device;

a second moving device which causes relative movement between the application roller and the measuring roller to change a distance between the application roller and the measuring roller; and a movement controlling device configured to control the second moving device in such a manner that, when the application roller and the medium are brought into abutment with each other from a state in which the application roller and the medium are separated from each other, a front end part of the medium in terms of the conveyance direction abuts with an abutment position on a circumferential surface of the application roller when the application roller and the measuring roller are brought into abutment with each other from a state in which the application roller and the measuring roller are separated from each other, wherein the movement controlling device is configured to control the second moving device so as to separate the application roller and the measuring roller from each other when an abutment position on the circumferential surface of the application roller which is brought into abutment with a rear end part of the medium in terms of the conveyance direction reaches the abutment position in which the application roller and the measuring roller are brought into abutment with each other.

4. The application apparatus as defined in claim 3, wherein the movement controlling device is configured to control the first moving device so as to separate the medium conveying device and the application roller from each other when a rear end part of the medium in the conveyance direction reaches an abutment position in which the medium and the application roller are brought into abutment with each other.

5. An application apparatus comprising:

a medium conveying device which holds and conveys a medium in a predetermined conveyance direction;

an application roller which applies a liquid to the medium held by the medium conveying device;

an application roller rotating device which rotates the application roller at a predetermined rotational speed;

a measuring roller which feeds a predetermined measured amount of the liquid to the application roller;

a measuring roller rotating device which rotates the measuring roller at a predetermined rotational speed;

a first moving device which causes relative movement between the application roller and the medium conveying device to change a distance between the application roller and the medium conveying device;

a second moving device which causes relative movement between the application roller and the measuring roller to change a distance between the application roller and the measuring roller; and a movement controlling device configured to control the second moving device in such a manner that, when the application roller and the medium are brought into abutment with each other from a state in which the application roller and the medium are separated from each other, a front end part of the medium in terms of the conveyance direction abuts with an abutment position on a circumferential surface of the application roller when the application roller and the measuring roller are brought into abutment with each other from a state in which the application roller and the measuring roller are separated from each other, wherein, when a moving distance of the circumferential surface of the application roller from the abutment position in which the application roller and the measuring roller are brought into abutment with each other to an abutment position in which the application roller and the medium are brought into abutment with each other, is taken as $L_1$, and when a moving distance of a rear end part of the medium from the position of the rear end part of the medium at timing of when the application roller and the measuring roller are brought into abutment with each other, to the abutment position in which the application roller and the medium are brought into abutment with each other, is taken as $L_3$, the movement controlling device is configured to control an operation timing of the first moving device and an operation timing of the second moving device in such a manner that a relationship of $L_1=L_3$ is satisfied.

6. The application apparatus as defined in claim 1, further comprising a measuring device which measures a fluctuation of a conveyance speed of the medium, wherein the movement controlling device is configured to correct timing of when the application roller and the medium are brought into abutment with each other in accordance with the fluctuation of the conveyance speed of the medium which is measured by the measuring device, to control the first moving device.

7. An application apparatus comprising:

a medium conveying device which holds and conveys a medium in a predetermined conveyance direction;

an application roller which applies a liquid to the medium held by the medium conveying device;

an application roller rotating device which rotates the application roller at a predetermined rotational speed;

a measuring roller which feeds a predetermined measured amount of the liquid to the application roller;

a measuring roller rotating device which rotates the measuring roller at a predetermined rotational speed;

a first moving device which causes relative movement between the application roller and the medium conveying device to change a distance between the application roller and the medium conveying device;

a second moving device which causes relative movement between the application roller and the measuring roller to change a distance between the application roller and the measuring roller; and a movement controlling device configured to control the second moving device in such a manner that, when the application roller and the medium are brought into abutment with each other from a state in which the application roller and the medium are separated from each other, a front end part of the medium in terms of the conveyance direction abuts with an abutment position on a circumferential surface of the application roller when the application roller and the measuring roller are brought into abutment with each other from a state in which the application roller and the measuring roller are separated from each other, wherein:

the application roller has a recess part extending in an axial direction, and the movement controlling device is configured to control the first moving device so as to bring the recess art and the measuring roller into abutment with each other when the application roller and the measuring roller are brought into abutment with each other from a state in which the application roller and the measuring roller are separated from each other, and wherein the movement controlling device is configured to control the second moving device so as to bring the recess part into contact with the front end part of the medium in the conveyance direction.

* * * * *